US008870174B2

(12) United States Patent
Mueller

(10) Patent No.: US 8,870,174 B2
(45) Date of Patent: Oct. 28, 2014

(54) MACHINE FOR PRODUCING BOOKS, IN PARTICULAR PHOTO BOOKS AND/OR ILLUSTRATED BOOKS

(75) Inventor: Markus Mueller, Wolfschlugen (DE)

(73) Assignee: Kugler-Womako GmbH, Nuertingen (DE)

( * ) Notice: Subject to any disclaimer, the term of this patent is extended or adjusted under 35 U.S.C. 154(b) by 295 days.

(21) Appl. No.: 13/440,177

(22) Filed: Apr. 5, 2012

(65) Prior Publication Data

US 2012/0275881 A1 Nov. 1, 2012

(30) Foreign Application Priority Data

Apr. 6, 2011 (DE) ..... 10 2011 006 905

(51) Int. Cl.
*B42C 19/00* (2006.01)
*B42D 1/08* (2006.01)
*B42C 19/06* (2006.01)

(52) U.S. Cl.
CPC . *B42C 19/06* (2013.01); *B42D 1/08* (2013.01); *B42P 2201/02* (2013.01)
USPC ..... 270/52.07; 270/52.09; 270/52.2; 270/45

(58) Field of Classification Search
CPC ..... B42C 19/00
USPC ..... 270/41, 52.02, 52.07, 52.08, 52.09, 45
See application file for complete search history.

(56) References Cited

U.S. PATENT DOCUMENTS 5,702,219 A * 12/1997 Hattori ..... 412/6
5,868,539 A * 2/1999 Rathert ..... 412/5
8,002,257 B2 * 8/2011 Dawley et al. ..... 270/52.17
8,087,653 B2 * 1/2012 Silberbauer ..... 270/52.02
8,291,798 B2 * 10/2012 Schafer et al. ..... 83/86
8,353,505 B2 * 1/2013 Kaneko et al. ..... 270/52.09
8,356,809 B2 * 1/2013 Dawley et al. ..... 270/21.1

(Continued)

FOREIGN PATENT DOCUMENTS

DE 197 29 529 A1 3/1998
EP 0 791 478 A1 8/1997

(Continued)

OTHER PUBLICATIONS

German Office Action in related application No. 102011006905, dated Nov. 11, 2012 (with partial English-language machine translation).

*Primary Examiner* — Patrick Mackey
(74) *Attorney, Agent, or Firm* — Greenblum & Bernstein, P.L.C.

(57) ABSTRACT

Machine for producing books, in particular photo books and/or illustrated books includes sheet web dispensing station for dispensing a sheet web moved in its longitudinal direction, printed and/or coated and/or phototechnically processed on one side and provided with print marks and/or print job codes, cross-cutting station arranged downstream of the sheet web dispensing station, grooving and creasing station arranged downstream of the cross-cutting station for the central grooving and creasing of the sheets crosswise to their direction of movement, laminating station for the flat connection of several consecutive creased sheets to one another, three-side cutting station, book cover supply station for supplying and feeding a respectively predetermined individual book cover for the respective book block, joining station downstream of the three-side cutting station for joining book block and assigned book cover and dispensing station for dispensing the completed books.

46 Claims, 12 Drawing Sheets

(56) References Cited

U.S. PATENT DOCUMENTS

| | | | | |
|---|---|---|---|---|
| 8,540,226 | B2 * | 9/2013 | Yap et al. | 270/52.02 |
| 2002/0195764 | A1 * | 12/2002 | Sosalla | 270/41 |
| 2006/0175745 | A1 * | 8/2006 | Gunther | 270/52.07 |
| 2008/0088075 | A1 * | 4/2008 | Graushar et al. | 270/1.02 |
| 2008/0277858 | A1 * | 11/2008 | Shichijo et al. | 270/12 |
| 2010/0104400 | A1 | 4/2010 | Silberbauer | |

FOREIGN PATENT DOCUMENTS

| | | | |
|---|---|---|---|
| EP | 2 179 859 | A1 | 4/2010 |
| EP | 2266814 | A2 * | 12/2010 |
| EP | 2269823 | A1 * | 1/2011 |

* cited by examiner

MACHINE FOR PRODUCING BOOKS, IN PARTICULAR PHOTO BOOKS AND/OR ILLUSTRATED BOOKS

CROSS-REFERENCE TO RELATED APPLICATIONS

The present application claims priority under 35 U.S.C. §119 of German Patent Application No. 10 2011 006 905, filed on Apr. 6, 2011, the disclosure of which is expressly incorporated by reference herein in its entirety.

BACKGROUND OF THE INVENTION

Field of the Invention

The invention relates to a machine for producing books, in particular photo books and/or illustrated books.

SUMMARY OF THE INVENTION

The object of the present invention is to create a machine of the above-mentioned type, with which continuously, different, immediately consecutive lay-flat books, in particular lay-flat photo books and/or illustrated books can be produced.

This object is attained with a machine for producing books, in particular photo books and/or illustrated books, with a sheet web dispensing station for dispensing a sheet web moved in its longitudinal direction, printed and/or coated and/or phototechnically processed on one side and provided with print marks and/or print job codes, with at least one supply device for supplying the sheet web, a downstream sheet web storage device and a first conveyor device for drawing the sheet web off the supply means of the sheet web and for conveying the sheet web into the sheet web storage device, a cross-cutting station downstream of the sheet web dispensing station, with a sensor device for detecting print marks and/or print job codes located on the sheet web and for emitting an output signal representing the result of the detection, a downstream cross-cutting unit, which is embodied to cut the sheet web into discrete sheets lying one behind the other in the direction of movement, a second conveyor device, which is embodied to convey the sheet web out of the sheet web dispensing station depending on the output signal of the sensor device intermittently and/or with format accuracy and/or register accuracy to the cross-cutting unit, and a third conveyor device downstream of the cross-cutting unit, which conveyor device is embodied to convey the discrete sheets away, while achieving a predetermined distance from one another, a grooving and creasing station downstream of the cross-cutting station for centrally grooving and creasing the sheets crosswise to their direction of movement, a laminating station for the flat connection of several consecutive creased sheets to one another, with an adhesive application device for the application of adhesive essentially over the entire surface of the top of the creased sheets, a stacker that is embodied to stack several sheets to form a book block one on top of the other, and a pressing device for applying pressure in an essentially flat manner to the respectively uppermost creased sheet, a three-side cutting station with a fourth conveyor device, which is embodied to convey the book block from the laminating station into the three-side cutting station depending on a selected format such that the front edge of the book block lying opposite the book spine comes to rest on a defined cutting line running essentially crosswise to the direction of movement of the book blocks, a cross-cutter arranged along the cutting line and two lateral cutters, which are spaced apart from one another essentially crosswise to the direction of movement of the book blocks and arranged in a crosswise adjustable manner for the purpose of format adjustment, a book cover supply station for supplying and feeding a respectively predetermined individual book cover for the respective book block, with a supply means for supplying the book covers and a fifth conveyor device for removing a book cover from the supply means and a grooving device for grooving the book cover to produce a strip-shaped center section forming the spine of the book, which is bordered by two grooves and divides the book cover into two halves, a joining station downstream of the three-side cutting station for joining a book block and an assigned book cover, with a sixth conveyor device for bringing the book block into a joining position, an adhesive application device, which is embodied to apply adhesive in an essentially flat manner on the two outsides of the book block, while the sixth conveyor device moves the book block through the adhesive application device, a seventh conveyor device for bringing the individual book cover into the joining position and a book cover feeding device for placing the two halves of the book cover onto the outsides, provided with adhesive, of the book block for completing the book and a removal device for removing the finished book, and a dispensing station for dispensing the completed books, preferably to a downstream packing machine.

The machine according to the invention renders possible a continuous production of directly consecutive lay-flat books, in particular lay-flat photo books and/or illustrated books with laminating binding, that are different regarding content, number of sheets or pages and format.

A lay-flat binding renders possible not only a flat form of the book in the closed condition and easily turned pages, but also prevents the pages from bulging when the book is opened. In fact when a lay-flat book is opened the pages thereof are opened flat, so that in the opened condition of the book two adjacent pages lie flat essentially in a common plane. Thus with a lay-flat photo book or lay-flat illustrated book pictures can also be easily arranged in the center and photo books or illustrated books of this type are also ideally suited for panorama photos, which extend over two adjacent pages.

A conventional spine binding is omitted completely due to the invention, which considerably simplifies the binding process.

The machine according to the invention renders possible the production of complete lay-flat books in a closed process chain, whereby additional transport operations and/or process interfaces and thus possibly resulting error sources, waiting times and faulty productions are considerably reduced.

Preferred embodiments and further developments of the invention are disclosed in the subordinate claims.

Thus for example the cross-cutting unit can have in the cross-cutting station a rotatable blade carrier, on which a helical blade is arranged, and a counter-blade arranged in a stationary manner. In particular due to the stationary arrangement of the counter blade, this embodiment leads to a cost-effective solution, which nevertheless permits the desired format flexibility with blade carriers driven in a non-uniform manner.

Furthermore, for example, the laminating station can have a cooling device for cooling the adhesive connections in the book block, which leads to a higher production speed due to a shorter binding time and cooling time of the adhesive, preferably comprising a hot adhesive, in the book block.

In the book cover supply station, the grooving device can have at least one, preferably vertical grooving knife arranged in a moveable manner and at least one counter strip arranged in a stationary manner. An embodiment of this type renders possible a format adjustment online, as it were, shortly before the joining of the book cover to an assigned individual book block, in particular with different thicknesses and/or lengths and/or width measurements.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

Figure 1:
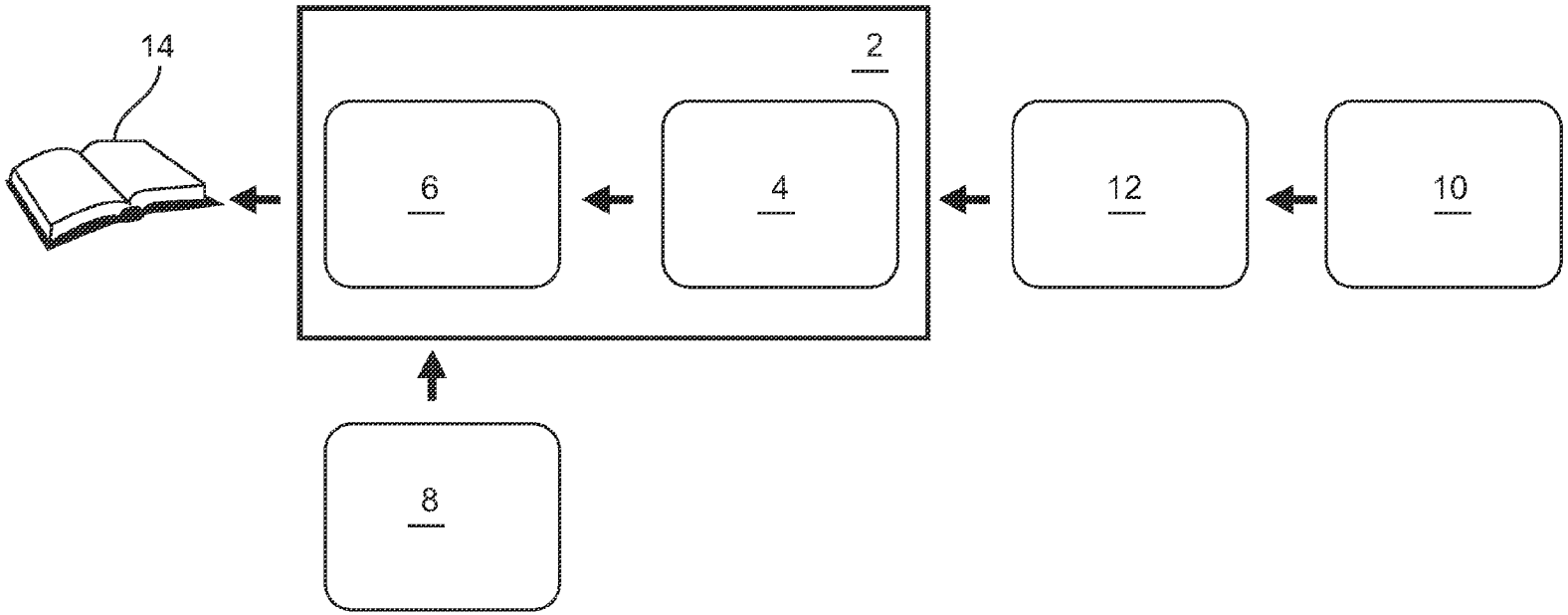
FIG. 1 diagrammatically in a rough flow chart the most important steps for the production of a photo book.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The system shown in the figures is a photo book machine according to a preferred exemplary embodiment of the invention with which continuously different, directly consecutive so-called "lay-flat" photo books with laminating binding can be produced, wherein this also applies to the content, to the number of sheets or pages and within certain limits also to the format. In this context it should be noted that the photo book machine described below can also be used for the production of other types of lay-flat books, such as for example lay-flat illustrated books.

With lay-flat books a plurality of creased sheets are assembled to form a stack and thereby respectively two halves next to one another of two adjacent sheets are adhered to one another to form a common page. The spine of the inner book block formed from the said stack is then formed by the crease edges lying next to one another of the individual sheets. The book block is provided with a book cover. While the sheets and the pages formed therefrom are generally composed of paper or film, for the production of the book covers a stronger material, such as in particular cardboard, is used. The book cover is provided in the center with two grooves spaced apart from one another.

The two grooves enclose between them a narrow strip-shaped section, which forms the outer book spine. Through the arrangement of these two grooves and the narrow book spine section lying between them, the book cover is divided into two halves, with which the book cover is adhered to the outsides of the book block, wherein the one half forms the front book cover board and the other half of the book cover forms the back book cover board. The grooves in the book cover act as a film hinge when the book is opened, wherein the narrow strip-shaped section between the two grooves forming the outer book spine is pressed outwards when the book is opened.

The lay-flat binding previously described permits not only a flat form of the book in the closed condition, but also prevents the pages from bulging when the book is opened. In fact, when a lay-flat book is opened the pages thereof can be opened flat so that in the opened condition of the book two adjacent pages essentially lie flat in a common plane. Thus with a lay-flat photo book pictures can also be easily placed in the center and such photo books are also ideally suitable for panorama photos that extend over two adjacent pages. Moreover, leafing through a lay-flat book can be carried out in a much simpler and more elegant manner.

To clarify the production of a photo book in FIG. 1 the most important steps are shown diagrammatically in the manner of a flow chart. The photo book machine 2 there takes on a central importance, which in particular contains the "book block production" function labeled as block 4 and the downstream function "mounting the book cover" labeled as block 6. In the representation of FIG. 1, block 8 represents the supply and production of the book cover. Even though in FIG. 1 the supply and production of the book cover according to block 8 is shown outside the photo book machine 2, alternatively it is also conceivable to additionally integrate the supply and production of the book covers into the photo book machine 2.

With the production of customer-specific photo books, this is not the production of a plurality of identical books in an increased batch in the manner of serial production, but the production of unique items, which differ individually with respect to the content, the number of sheets or pages and within certain limits also with respect to the format. Accordingly, the photo book machine 2 is designed such that it can react to corresponding changes from book to book in running operation. The photo book machine is generally used by a photo lab to which the customer sends his photos or pictures together with further information such as in particular text information as well as specifications regarding the number of sheets or pages and format. The pictures and other information must thereby be provided by the customer in a specific data format.

The corresponding data are subjected by the photo lab to a data processing, which is labeled by block 10 in FIG. 1. Subsequently, an exposure and development of the photos is carried out, which is indicated by block 12 in FIG. 1. The photos are applied together with these print marks and print job codes uniquely assigned thereto onto a sheet web, which is usually composed of photo paper and is wound to form a roll in a winding station. A corresponding book block is produced from a sheet web roll of this type in the book block production 4 of the photo book machine 2. However, since not only the inner pages of a photo book are provided with photos supplied by the customer, but in addition there is also the option of an individual design of the book cover in particular by means of further photos supplied by the customer, a corresponding production of the associated book cover also takes place at the same time as the book block production. This must take place essentially synchronously and it must be ensured therein that in the step according to block 6 of FIG. 1 the correct book cover is joined to the correct book block in order to complete the desired photo book 14 therefrom.

Figure 2:
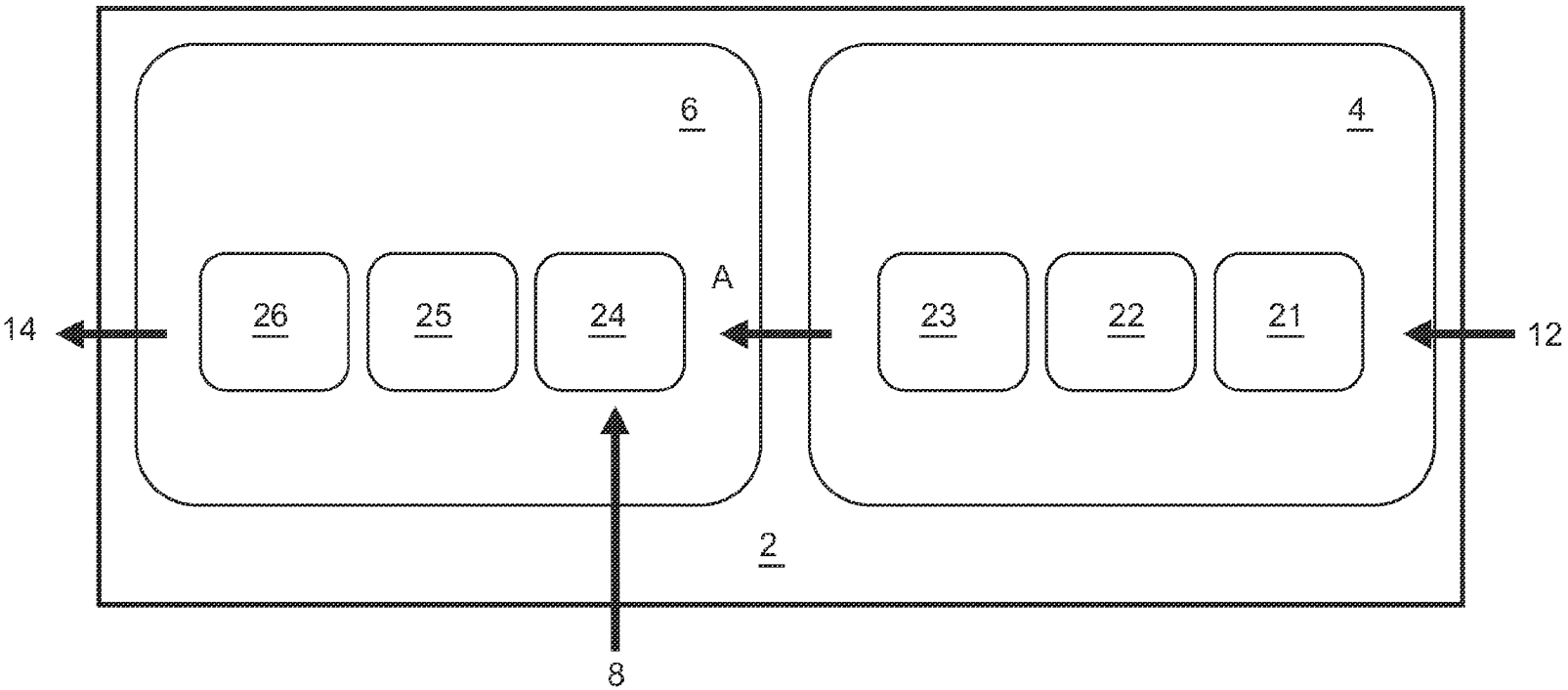
FIG. 2 in an overview representation a diagrammatic block diagram of a photo book machine according to a preferred exemplary embodiment of the invention.

FIG. 2 shows the rough structure of the photo book machine 2 from FIG. 1 in the form of a block diagram. In the exemplary embodiment shown, the photo book machine 2 is essentially divided into six assemblies or modules 21 through 26, of which the first three modules 21 through 23 are assigned to the book block production 4 and the last three modules 24 through 26 are assigned to the "mounting of the book cover" function labeled by block 6.

The first module 21 contains the functions rolling, bending and feeding the sheet web and cutting the sheet web into individual sheets. In the second module 22, the individual sheets are grooved, creased and glued and laminated and pressed to form book blocks, which are subsequently cooled. In the third module 23 the book blocks received from the second module 22 are subjected to a three-side cut to produce the desired format.

In the fourth module 24, the book cover is placed and accordingly aligned, which belongs to the book block issued from the third module 23, that is, is assigned thereto, and has been produced essentially simultaneously with the production of that book block. The joining of the book cover prepared accordingly by this point to the associated book block likewise prepared accordingly by this point takes place in the fifth module 25. In the exemplary embodiment shown the book block is thereby inserted into the associated book cover. Concretely, in the preferred exemplary embodiment discussed here, in the fifth module 25 the book block is rotated and placed upright with its spine upwards before a saddle plate moves into the book block from below. The saddle plate grasps into the spine area in the interior of the book and takes the book block with it in an upward movement. During the upward movement, the book block passes through an adhesive application station, wherein the two outsides of the book block are provided with adhesive in an essentially flat manner. With continued upward movement the book block with its spine reaches a joining position into which the associated book cover has been placed centrally. With continued upward movement by the saddle plate, the book block reaches with its spine in the center of the book cover, which at this time is still in a form that is spread out flat horizontally. With further continued upward movement, the two halves of the book cover are folded in the direction of the two outsides of the book block provided with adhesive and adhered thereto, which is supported by corresponding press-on rollers. The book block then provided with the book cover is subsequently subjected to a crease pressing operation in the fifth module 25. By joining the book cover and the book block, an essentially completed book is produced, which is supplied via the sixth module 26, provided as a delivery preferably to a downstream packing machine, not shown.

In a modification (not shown) of the photo book machine, instead of the first module 21 described here, in which a sheet web is drawn off from a roll and cut into sheets, as an alternative first module a so-called sheet feeder can be provided, namely in the case that finished printed and/or exposed and/or coated individual sheets are supplied.

Concretely, in the exemplary embodiment in the fifth module 25 the book block is rotated and placed upright with its spine upwards before a saddle plate moves into the book block from below. The saddle plate grasps into the spine area in the interior of the book and takes the book block with it in an upward movement. During the upward movement the book block passes through an adhesive application station, whereby the two outsides of the book block are provided with adhesive in an essentially flat manner. With continued upward movement the book block reaches a joining position with its spine, in which the associated book cover has been placed centrally. With continued upward movement by the saddle plate, the book block reaches with its spine in the center of the book cover, which at this time is still in a form spread out flat horizontally. With further continued upward movement, the two halves of the book cover are folded onto the two outsides of the book block provided with adhesive and adhered thereto, which is supported by corresponding press-on rollers. The book block then provided with the book cover is subsequently subjected to a crease press operation in the fifth module 25.

Figure 3:
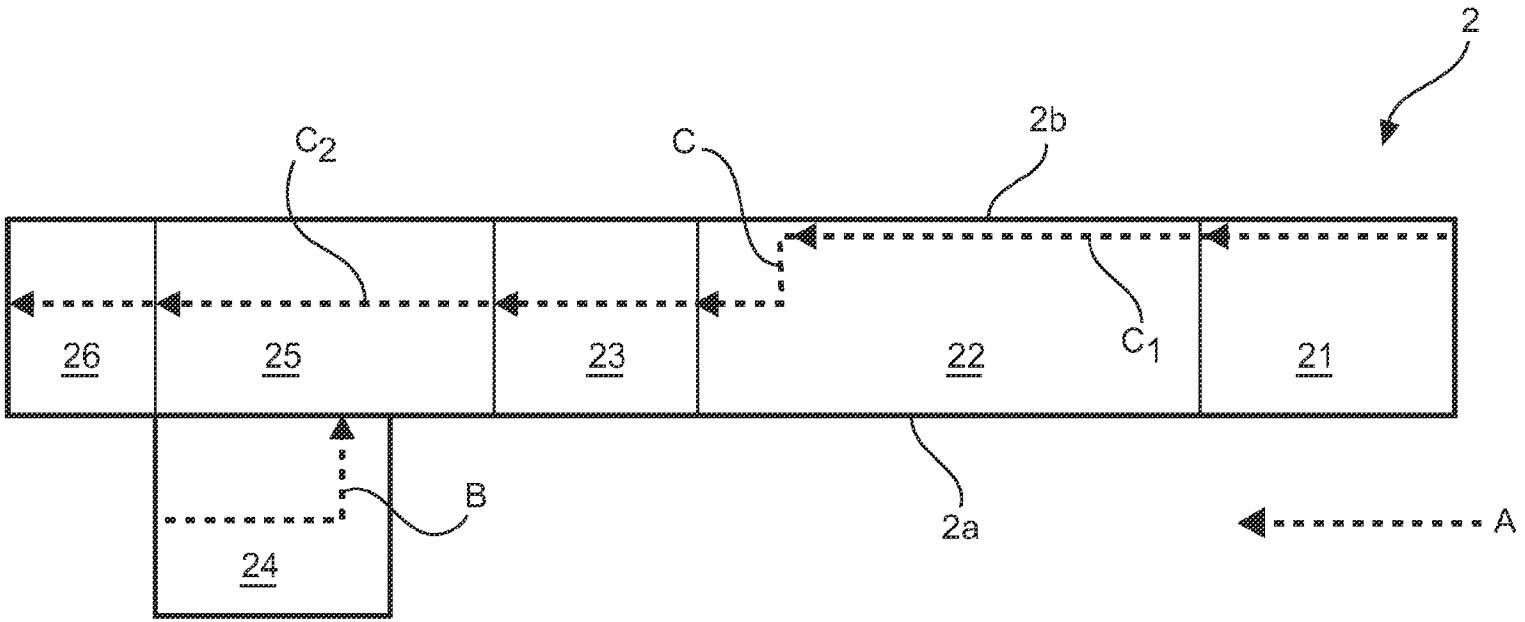
FIG. 3 diagrammatically as a block diagram the arrangement of different modules of the photo book machine from FIG. 2 with respect to one another according to a preferred embodiment of the invention.

It is shown by way of example in FIG. 3 how the six modules 21 through 26 can be arranged with respect to one another. Accordingly the first module 21, the second module 22, the third module 23, the fifth module 25 and the sixth module 26 are placed essentially in a row. The arrow A represents the transport direction or conveyor direction or paper travel direction, in which the sheet web, the sheets cut therefrom, the book blocks in turn produced therefrom and the completed books move. The transport direction according to arrow A at the same time also forms the process direction. Seen in the transport direction according to arrow A, accordingly the modules 21, 22, 23, 25 and 26 are placed one behind the other. The arrangement thus formed has a front 2*a* and a back 2*b*. As FIG. 3 further shows, the fourth module 24 for the feeding and alignment of the book cover in the exemplary embodiment shown is not contained in the row formed by the other modules 21 through 23, 25 and 26, but is arranged in the region of the fifth module 25 on the front 2*a* so that the book covers are brought into the fifth module 25 transversely to the transport direction of the book blocks according to arrow A, as the arrow B shows.

The photo book machine 2 is accessible via its front 2*a* by the operators in particular for repair and maintenance work. Accordingly a housing for the photo book machine 2 is designed in an open manner on the front 2*a* thereof, so that the relevant components can be reached for all modules. However, it should preferably be possible to close the front 2*a* by transparent hoods, flaps and/or doors. In contrast, the photo book machine 2 can have an essentially closed wall on its back 2*b*, which wall can preferably contain doors if necessary.

Furthermore, in FIG. 3 a further dashed line is discernible, which is labeled by the letter "C." In the exemplary embodiment shown, this line C is a reference line, which is used for the defined guidance and alignment of the sheet web, the sheets, the book blocks and the completed books. In the exemplary embodiment shown according to FIG. 3, the reference line C is thereby divided into a first section $C_1$ located upstream and a second section $C_2$ located downstream. The first section $C_1$ of the reference line C runs from the first module 21 into the second module 22 and defines a lateral reference line for a longitudinal side of the sheet web and the sheets cut therefrom. As FIG. 3 further shows, in the exemplary embodiment shown, this first section $C_1$ of the reference line C runs adjacent to the back 2*b* of the photo book machine 2. The second section $C_2$ of the reference line C runs from the second module 22 through the third module 23, the fifth module 25 into the sixth module 26 and in contrast to the first section $C_1$ defines a reference line for the center line of the book blocks and the completed books. The use of a reference line of this type in the manner of a machine zero edge facilitates the transport and the processing of the sheets and book blocks with different formats, since with the aid of a reference line of this type the sheets and book blocks can always be correctly positioned for processing even with different formats.

The structure and the function of a preferred exemplary embodiment of the photo book machine 2 is described in more detail below based on FIGS. 4 through 7 as well as 10*a* and 10*b*.

Figure 4:
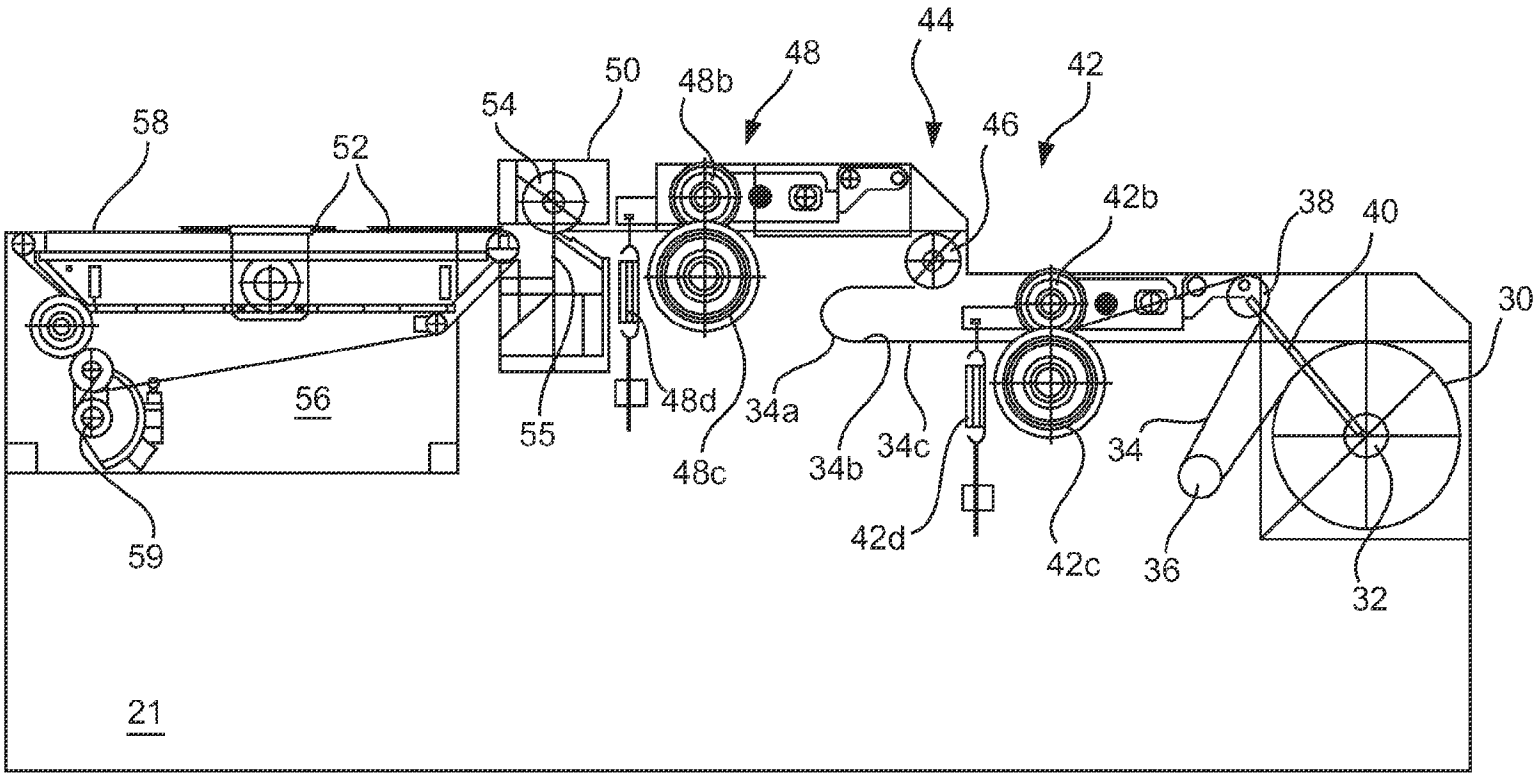
FIG. 4 in side view a first module of the photo book machine according to a preferred exemplary embodiment of the invention having a sheet web dispensing station and a cross-cutting station.

The structure of the first module 21 is shown in side view by way of example in FIG. 4. A sheet web roll 30 is discernible, which is rotatably supported on a winding mandrel 32. The sheet web roll 30, as was previously mentioned, has already been provided with customer-specific photos and other information as well as with uniquely assigned print marks and print job codes. A sheet web, which is labeled by reference number "34" in FIG. 4, is drawn off the sheet web roll 30 with the help of a drive 32*a*, not shown in FIG. 4 but shown diagrammatically in FIG. 10*a*, which correspondingly sets the winding mandrel 32 in rotation. After it has been drawn off the sheet web roll 30, the sheet web 34 is deflected via a fixed roll 36 in the direction of a moveable roll 38, which is located at the free end of an arm 40, which is pivoted about a rotation point, which in the exemplary embodiment shown coincides with the rotation point of the winding mandrel 32. The arm 40 is biased by a spring, not shown, or another assembly in a resilient yet yielding manner, namely in the clockwise direction in the representation of FIG. 4. In this manner the tension in the sheet web 34 is regulated and in particular the tension is thereby prevented from exceeding a maximum value and threatening to tear the sheet web 34 as a result. Accordingly, the roll 38 therefore forms a tension-regulating element. After the roll 38, the sheet web 34 is moved past a sensor device 41, not shown in FIG. 4, but shown diagrammatically in FIG. 10*a*, which is used by way of example for the control or regulation of the web speed of the sheet web 34, and the sheet web 34 runs through a first pair of tension rollers 42, which are provided for drawing the sheet web 34 off the sheet web roll 30 and for conveying the sheet web 34 into a downstream sheet web storage device 44 and is driven by a drive 42*a*, not shown in FIG. 4, but shown diagrammatically in FIG. 10*a*. Instead of an active drive 32*a* for the winding mandrel 32 or in addition to a drive 32*a* of this type, a passive mechanical brake or an active electrical motor brake, which can also be a component of the drive 32*a*, can be provided; if instead of an active drive 32*a*, only a brake is provided, the sheet web 32 is drawn off the sheet web roll 30 by the first pair of tension rollers 42. With the use of an in particular passive mechanical brake, a brake of this type should preferably be controlled with the aid of the arm 40.

The first pair of tension rollers 42 has a conveyor roller 42*b* arranged above the sheet web 34, which conveyor roller can preferably be provided with a suitable non-metallic surface for an impression-free engagement with the picture side or print side 34*b* of the sheet web 34 having a coating, and a lower conveyor roller 42*c* facing towards the opposite side 34*c* of the sheet web 34, which lower conveyor roller is preferably provided with a smooth metallic surface. Furthermore, FIG. 4 also shows an adjustment means 42*d* for adjusting the pressing force between the upper conveyor roller 42*b* and the lower conveyor roller 42*c* for gently conveying the sheet web.

In the exemplary embodiment shown, the effect of the sheet web storage device 44 results from the formation of loops of different length or size, of which the loop 34*a* is shown in FIG. 4 by way of example. After the formation of the loop(s) 34*a*, the sheet web 34 is deflected around a roll 46 and drawn out of the sheet web storage device 44 by a second pair of tension rollers 48. The sheet web storage device 44 is used to uncouple the subsequent processes from the feed of the sheet web 34 from the sheet web roll 30, in particular in order to compensate for differences between the processing speed in the subsequent processes and the feed rate of the sheet web roll 30.

Figure 10A:
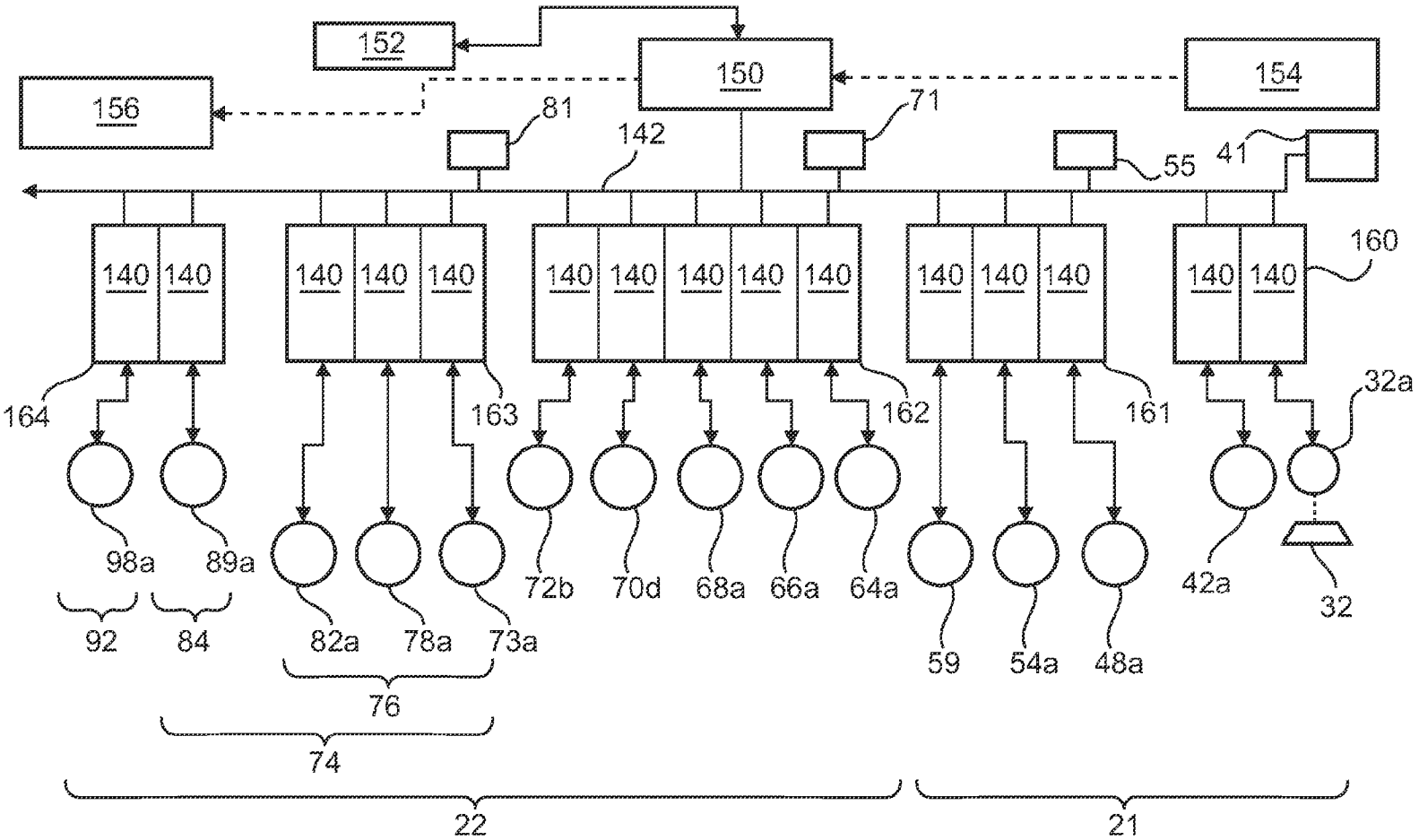
FIG. 10*a* diagrammatically in a block diagram representation a first part of a drive configuration of the photo book machine.

A second pair of tension rollers 48, which are set in rotation by a drive 48*a*, not shown in FIG. 4 but shown diagrammatically in FIG. 10*a*, conveys the sheet web 34 into a cross-cutting unit 50, in which the sheet web 34 is cut into individual sheets 52 lying one behind the other in the direction of movement according to arrow A. The second pair of tension rollers 48 likewise have an upper conveyor roller 48*b* and a lower conveyor roller 48*c* as well as an adjustment means 48*d* for adjusting the pressing force between the upper conveyor roller 48*b* and the lower conveyor roller 48*c*, wherein the surface consistency of the conveyor rollers 48*b*, 48*c* is preferably similar or identical to that of the conveyor rollers 42*b*, 42*c* of the first pair of tension rollers 42.

The cross-cutting unit 50 has a blade carrier 54 held in a rotatable manner, on which a helical blade, not shown, is held, and a stationary counter blade 55. The blade carrier 54 is set into a rotational movement by a drive 54*a*, not shown in FIG. 4 but shown diagrammatically in FIG. 10*a*. While running through the cross-cutting unit 50, the picture side or print side 34*b*, provided with the coating, of the sheet web 34 points upwards to the blade carrier 54 and thus the picture side or print side 34*b* of the sheet web 34 is directed upwards. Furthermore, a sensor device 55 for detecting print marks and print job codes on the sheet web 34, not shown in FIG. 4 either but shown diagrammatically in FIG. 10*a* is provided upstream in front of the blade carrier 54. Moreover, the second pair of tension rollers 48 are conveyed depending on the output signal of the sensor device 55 by the associated drive 48*a* (FIG. 10*a*) intermittently and with register accuracy and/or format accuracy to the cross-cutting unit 50.

Downstream of the cross-cutting unit 50, a suction belt conveyor 56 is arranged, the endlessly circulating conveyor belt 58 of which provided with suction openings, not shown, receives the cut discrete sheets 52 with their picture side or print side upwards from the cross-cutting unit 50 and transports them away from the first module 21. As FIGS. 4 and 10*a* further show, the suction belt conveyor 56 has a drive 59, which sets the conveyor belt 58 in rotation. The conveyor speed and the acceleration of the conveyor belt 58 of the suction belt conveyor 56 are thereby adjusted such that the sheets 52 are transported away at a specific distance from one another.

Figure 5:
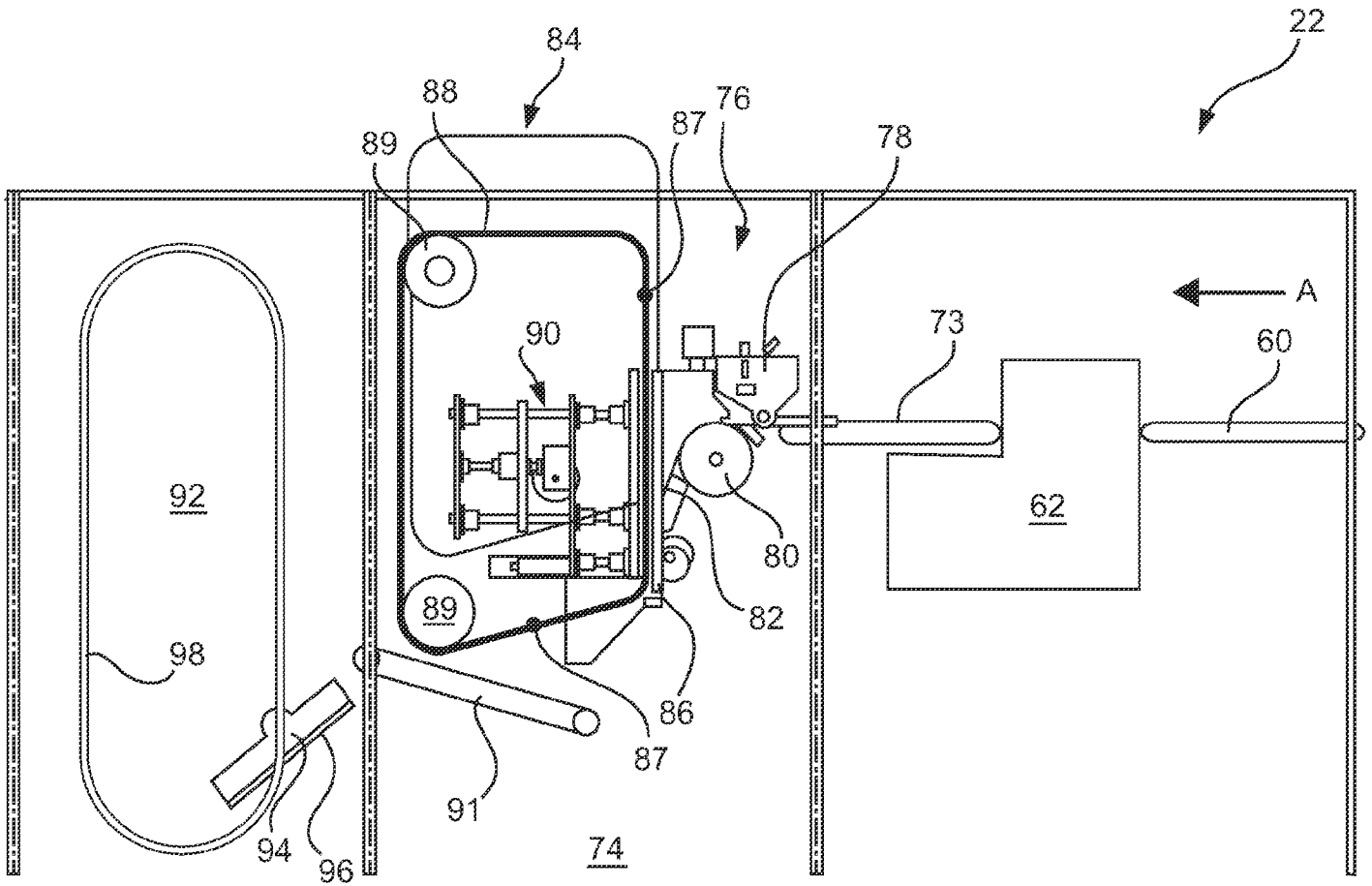
FIG. 5 in diagrammatic side view in particular a second module of the photo book machine according to a preferred exemplary embodiment of the invention having a grooving and creasing station and a laminating station with cooling device.

The sheets 52 are taken over consecutively from the suction belt conveyor 56 in the first module 21 by a further conveyor belt 60, which is part of the second module 22, the structure of which is shown by way of example in FIG. 5. By means of the conveyor belt 60 the sheets consecutively reach a grooving and creasing station 62, the structure of which is shown in more detail by way of example in FIG. 6. After having been drawn in by a pair of tension rollers 64, which are set in rotation by a drive 64*a*, not shown in FIG. 6 but shown diagrammatically in FIG. 10*a*, the sheet 52 is guided into the grooving and creasing station 62 by two dies 66, 67. The two dies 66, 67 serve as a grooving tool, in order to emboss a groove in the center of the sheet 52 running crosswise to the transport direction according to arrow A. While in the exemplary embodiment shown the lower die 67 is arranged in a stationary manner, the upper die 66 is moveably supported between an upper rest position spaced apart from the picture side or print side 52*b* of the sheet 52 and a lower operating position according to FIG. 6. To this end, the upper die 66 is set into a corresponding combined pivot movement and upwards or downwards movement by a lift drive 66*a*, not shown in FIG. 6 but shown diagrammatically in FIG. 10*a*, which performs a superimposed lifting and pivoting movement for the uninterrupted transport of the sheets 52. Subsequently, the sheet 52 thus grooved in the center comes into engagement with a transport roller 68 and with creasing rollers 70*a* through *c*. Drives 68*a*, 70*d* are provided for the transport roller 68 and the creasing rollers 70*a* through 70*c*, which drives are not shown in FIG. 6 but are shown diagrammatically in FIG. 10*a*. Furthermore, the grooving and creasing station 62 has a sensor device 71, which is not shown in FIG. 6 but is shown diagrammatically in FIG. 10*a* and is used in particular to recognize an entering sheet 52, so that the grooving and creasing station 62 is correspondingly controlled or regulated depending on the measurement result of this sensor device 71.

Figure 6:
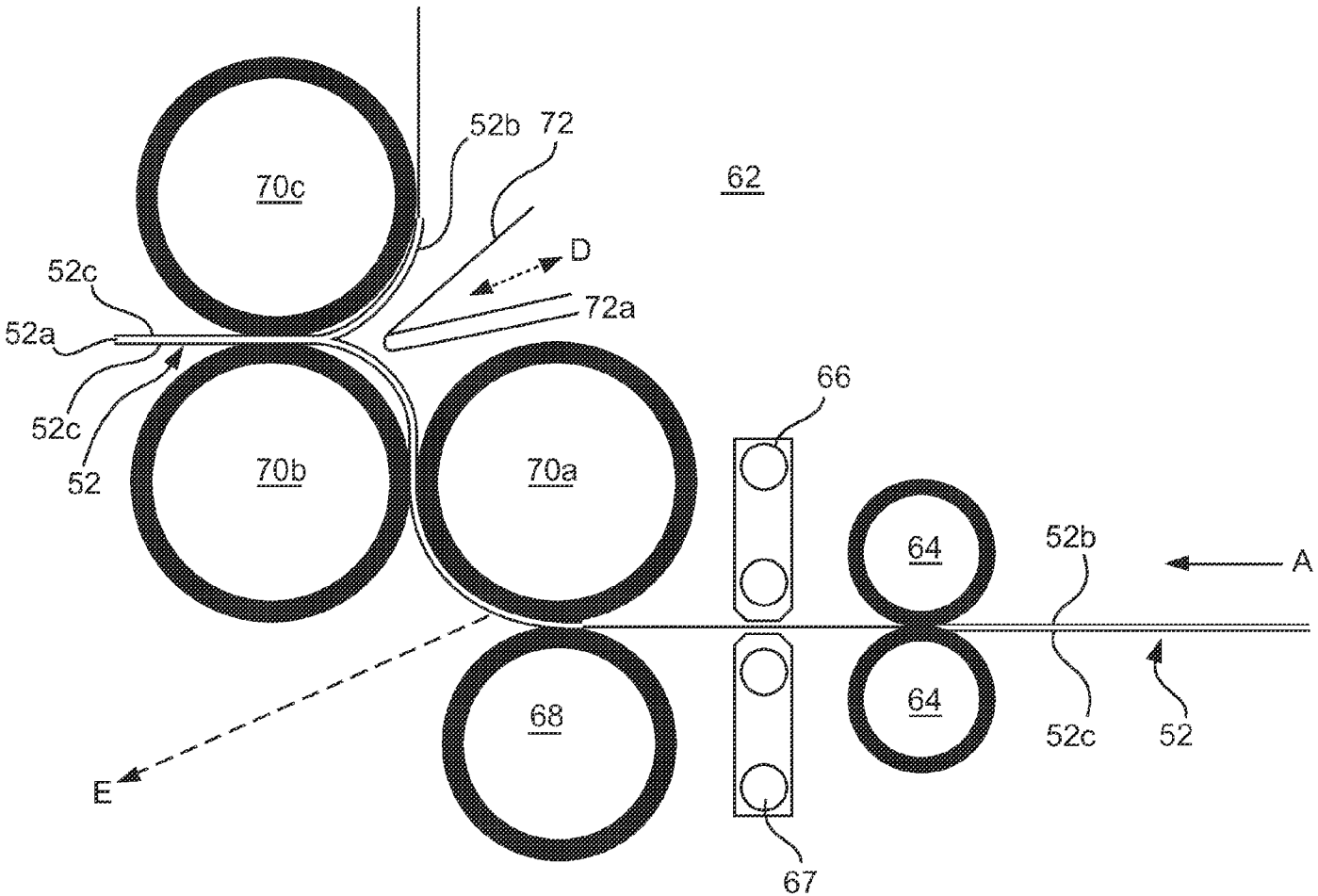
FIG. 6 an enlarged diagrammatic individual view of the grooving and creasing station contained in the second module of the photo book machine in side view.

Firstly the sheet 52 is drawn between the two creasing rollers 7*a, b* and conveyed vertically upwards thereby, whereby the sheet 52 is touched only on one side by the creasing roller 70*c*. The sheet 52 thereby comes to a stop and is acted on by the tip 72*a* of a so-called creasing knife 72, which is held in a moveable manner in the direction of the double arrow D on a stand, not shown, and is set into corresponding movement by a linear drive 72*b* not shown in FIG. 6 but shown diagrammatically in FIG. 10*a*. Through the movement of the knife 72 in the direction of the common area of engagement of the rollers 70*b, c*, the sheet 52 is carried along and correspondingly folded or creased, wherein the picture side or print side 52*b* comes to rest on the inside, as FIG. 6 shows. The sheet 52 must thereby be aligned such that the knife 72 with its tip 72*a* meets the groove previously embossed by the grooving device 66, 67. This groove accordingly forms the fold edge or crease edge of the sheet 52 creased by the crease knife 72. The sheet 52 is thereby creased such that the two halves thereof lie one on top of the other and the crease edge 52*a* is ahead. With its crease edge 52 ahead, thus the creased sheet 52 is drawn through the two creasing rollers 70*b, c* onto a downstream conveyor belt 73, which is set in motion by a drive 73*a*, not shown in FIG. 5, but shown diagrammatically in FIG. 10*a*.

Furthermore, in the exemplary embodiment shown here the grooving and creasing station 62 has an extraction device, not shown, which with the aid of the rollers 68, 70*a* extracts faulty sheets from the grooving and creasing station 62, which is indicated by the arrow E shown by a dashed line. The mentioned sensor device 71 (FIG. 10*a*) is likewise used for detecting faulty sheets, and the extraction device is correspondingly activated depending on the output signal of this sensor device 71 in order to extract a faulty sheet in the direction of the dashed arrow E.

As FIG. 5 now further shows, the conveyor belt 73 in the second module 22 connects the grooving and creasing station 62 to a laminating station 74 located downstream. The sheets 52, now creased, are conveyed by the conveyor belt 73 with their crease edge 52*a* in front (FIG. 6) in the transport direction according to arrow A to an adhesive application station 76, which forms a part of the laminating station 74 located upstream. The adhesive application station 76 has in particular a gluing device 78 with a glue nozzle strip, not shown, and a transport roller 80. Furthermore, the adhesive application station 76 can have at least one pair of feed rolls and a glue collection strip, which is not shown in FIG. 5, however. After the creased sheet, not shown in FIG. 5, has come into engagement with the transport roller 80, which lies below the glue nozzle strip arranged at the gluing device 78, and bears with its underside against the transport roller 80, it is guided past the glue nozzle strip. Now the unprinted side 52*c* forming the top of the sheet 52 is thereby exposed and can therefore be glued unhindered over the entire surface by the glue nozzle strip.

The glue nozzle strip or the entire gluing device 78 with the glue nozzle strip is supported so that it can be brought, preferably pivoted between a lower operating position and an upper rest position, which is not shown in FIG. 5. To this end a corresponding drive 78*a* is provided, which is not shown in FIG. 5, but is shown diagrammatically in FIG. 10*a*. The glue nozzle strip is subdivided into segments for a change of format width, which is not shown in FIG. 5 either. Likewise, the transport roller 80 below the gluing device 78 can be supported so that it can be brought, preferably pivoted, between an operating position, in which it can be brought into engagement with the underside of a sheet for the transport thereof, and a rest position, which is not shown in the figures either.

The adhesive application station 76 can furthermore be provided with a sensor device 81, not shown in FIG. 5 either, but shown diagrammatically in FIG. 10*a*, which sensor device recognizes the arrival and the presence of a sheet. Based on a corresponding signal from a sensor device 81 of this type, the gluing device 78 is then correspondingly controlled in order to apply glue onto the top of the folded upper half of the sheet. While the creased sheet, driven i.a. by the transport roller 80 is glued on the top of its folded upper half, the previously mentioned sensor device 81 recognizes the trailing edge and thus the end of the folded sheet and initiates with a defined delay the interruption of the glue flow and thus the switching off of the gluing device 78. The mentioned defined delay is thereby measured such that the top of the folded upper half of the sheet is fully glued and the dispensing of glue from the gluing device 78 is switched off exactly when a virtual line in the edge region of the sheet is reached. When the gluing process is switched off, the gluing device 78 or the glue nozzle strip thereof and the transport roller 80 can be respectively brought or pivoted into their rest position and thereby moved apart from one another.

As is further indicated in FIG. 5, a suction belt conveyor 82 tilted obliquely downwards connects downstream of the transport roller 80, which suction belt conveyor transfers the sheet now glued on the top of its folded upper half from an approximately horizontal alignment in the region of the adhesive application station 76 with its crease edge ahead into an alignment tilted markedly downwards. The suction conveyor 82 is driven by a drive 82*a* not shown in FIG. 5 but shown diagrammatically in FIG. 10*a*. The sheet thereby reaches the region of a stack forming station 84 located downstream, which likewise is part of the laminating station 74 in the second module 22.

In the exemplary embodiment shown, the stack forming station 84 has a lift table 86, which is vertically aligned so that the surface thereof forms a vertical plane. The glued folded sheet is aligned by the suction belt conveyor 82 into the above-mentioned tilted position such that the glued top of the folded upper half of the folded sheet points towards the lift table 86. By means of consecutive feeding of folded sheets, a stack, not shown in the figures, forms on the surface of the lift table 86. To this end, the folded sheets fed consecutively and already glued are thus stacked on the surface of the lift table 86. Since the surface of the lift table 86 forms the base of the stack, as it were, but is aligned vertically in the exemplary embodiment shown, the stack forms on the surface of the lift table 86 in the horizontal direction and therefore does not lie horizontally, but stands upright or on edge.

In order to adhere the glued top of each newly fed folded sheet to the respectively uppermost sheet of the stack formed up to this time on the lift table 86, the newly fed sheet must be pressed over the entire surface against the stack already formed. This takes place in the exemplary embodiment shown with the aid of horizontally aligned laminating or pressure rollers, which move from the bottom upwards over the surface of the lift table 86 and rub the respectively new sheet against the stack in the manner of a rolling pin.

FIG. 5 shows diagrammatically several pressure rollers 87, which are supported in a moveable manner along a closed guide path, which is not shown in FIG. 5. To this end, in the exemplary embodiment shown two conveyor chains spaced apart from one another are provided, of which the one conveyor chain is arranged on the one side of the stack forming station 84 and guided via gear wheels and the other conveyor chain is arranged on the other opposite side of the stack forming station 84 and is guided via gear wheels. In FIG. 5 the conveyor chains 88 facing the observer are discernible, which are guided by gear wheels 89 and deflected thereon. The arrangement and the course of the two conveyor chains 88 are identical. The pressure rollers 87 are arranged horizontally between the two conveyor chains 88, in that the pressure rollers are supported with their respective end in a bearing element, not shown, which is attached to the assigned conveyor chains 88.

So that the conveyor chains 88 can perform a circulating movement, at least one of the gear wheels 89 is set in rotation by a drive 89*a*, not shown in FIG. 5 but shown diagrammatically in FIG. 10*a*. According to the representation of FIG. 5, the circulating operation takes place in the opposite direction to the clockwise direction. A continuous and fully automatic operation can be realized by the circulating operation, in that a pressure roller 87 is provided for each newly delivered creased sheet. The distance between two adjacent pressure rollers and the work cycle are to be measured or adjusted at least in the second module 22 of the photo book machine 2 depending on one another such that a next pressure roller 87 is provided for each newly delivered creased sheet.

As FIG. 5 further shows, the stack forming station 84 has an adjustment device 90 in order to adjust the lift table 86 in the horizontal direction and thus perpendicular to the vertical surface thereof The lift table 86 is thereby drawn back by the adjustment device 90 during the stack formation such that the top of the stack remains essentially stationary. Accordingly, the lift table 86 is displaced by the adjustment device 90 depending on the thickness of the stack and depending on the increasing height or thickness of the growing stack as it were continuously into the stack forming station 84 and thus to the left according to the representation of FIG. 5. The distance of the pressure rollers 87 guided over the surface of the lift table 86 thus does not need to be newly adjusted respectively individually depending on the current height or thickness of the stack formed up to that point, instead a constant guide consistent for all pressure rollers 87 is sufficient, which is an advantage structurally and renders possible a bearing pressure that is always consistent.

After the completion of the stack and the end of the previously described laminating operation, the desired book block has been produced. This is subsequently transferred from the laminating station 74 with the aid of a conveyor device 91 into a cooling station 92. Only one circulating conveyor belt of the conveyor device 91 is shown diagrammatically in FIG. 5. In fact, the conveyor device 91 in addition has a gripper, not shown, with which the completed book block is removed from the lift table 86 and placed onto the conveyor belt 91.

In the exemplary embodiment shown, the cooling station 92, which in the exemplary embodiment shown is likewise a component of the second module 22 of the photo book machine 2, also has several plate-like cassettes in the exemplary embodiment shown, only one cassette 94 of which is shown by way of example in FIG. 5. With the aid of a transfer device, not shown in FIG. 5, which has a gripper, for example, the book block is transferred from the conveyor device 91 to a cassette 94. A book block 96 is shown diagrammatically on the underside of the cassette 94 in FIG. 5.

In the present exemplary embodiment, several cassettes are supported in a moveable manner along a closed guide path 98 and thereby arranged essentially equidistantly from one another. To this end a corresponding drive 98*a* is provided, which is not shown in FIG. 5, but is shown diagrammatically in FIG. 10*a*. In the exemplary embodiment shown the cassettes thereby hang on support elements, not shown, which are embodied, for example, as roller carriages and which move along the guide path 98. The hanging arrangement is discernible in FIG. 5 based on the cassette 94 shown in FIG. 5. With the aid of a drive device, not shown in FIG. 5, the cassettes with the book blocks located therein are set in a circulating operation along the guide path 98 through the cooling station 92.

For cooling in the cooling station 92, corresponding cooling units are provided, which are not shown in FIG. 5. The cooling causes a cooling down and an accelerated solidification or bonding of the adhesive in the book blocks resulting therefrom and thus the glue laminating binding thereof, since in the present exemplary embodiment hot glue or hot melt is used as an adhesive in the adhesive application station 76. A laminating by means of hot glue or hot melt and the immediately following cooling ensure a short binding period and thus a high production capacity.

After the cooling operation has ended, with the aid of a transfer device, not shown, the book blocks are removed consecutively from the suction holders and transferred to the third module 23 of the photo book machine 2 lying downstream seen in the transport direction according to arrow A.

The cooling station 92 preferably operates in continuous operation, in which the book blocks 96 taken over consecutively cyclically from the laminating station 74 are transferred to the suction holders 94 at a point that is adjacent to the conveyor device 91 and after a virtually complete circulation along the guide path 98 in a direction counter to the clockwise direction in the representation of FIG. 5 the book blocks 96 are removed again from the suction holders 94 at a point lying opposite.

Figure 7:
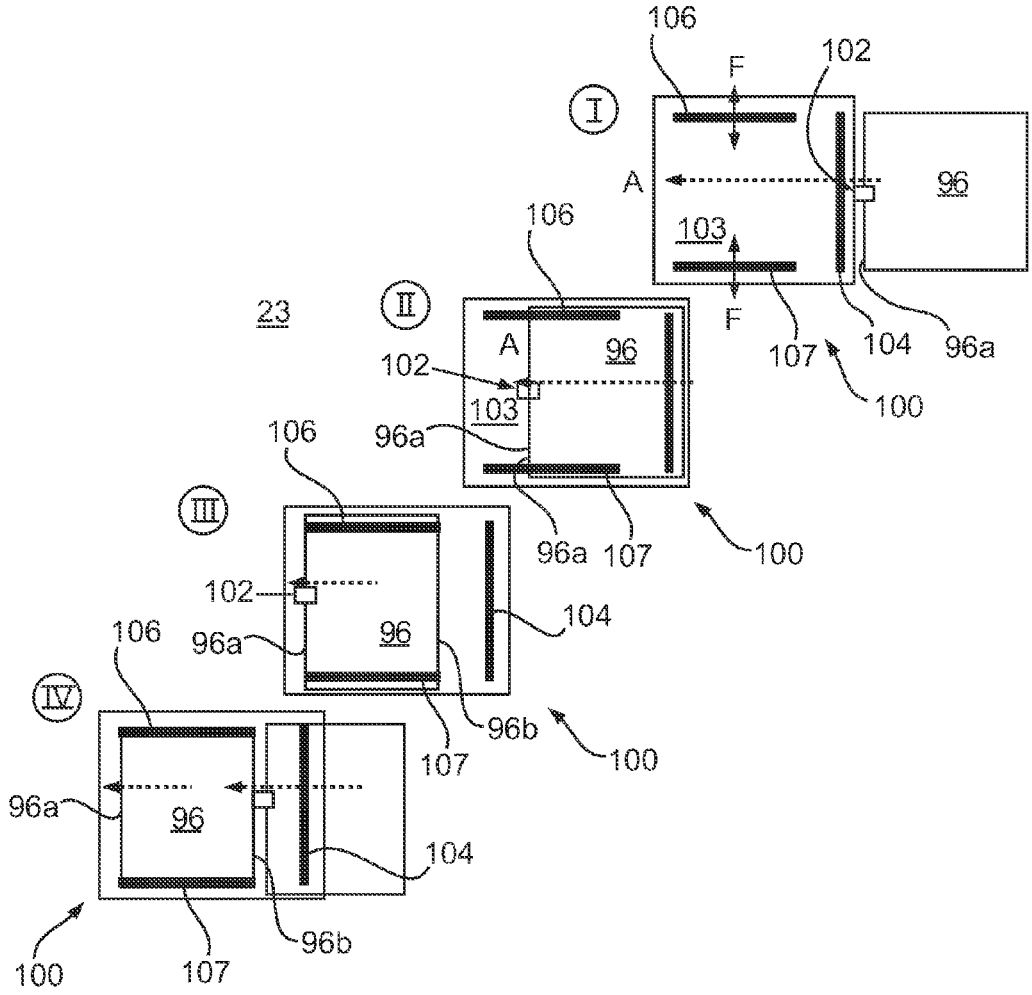
FIG. 7 in plan view a diagrammatic representation of the structure and the function of a three-side cutting station forming a third module of the photo book machine.

FIG. 7 shows diagrammatically in plan view the structure and the function of a preferred exemplary embodiment of a three-side cutting station 100 forming the third module 23 of the photo book machine 2.

Figure 10B:
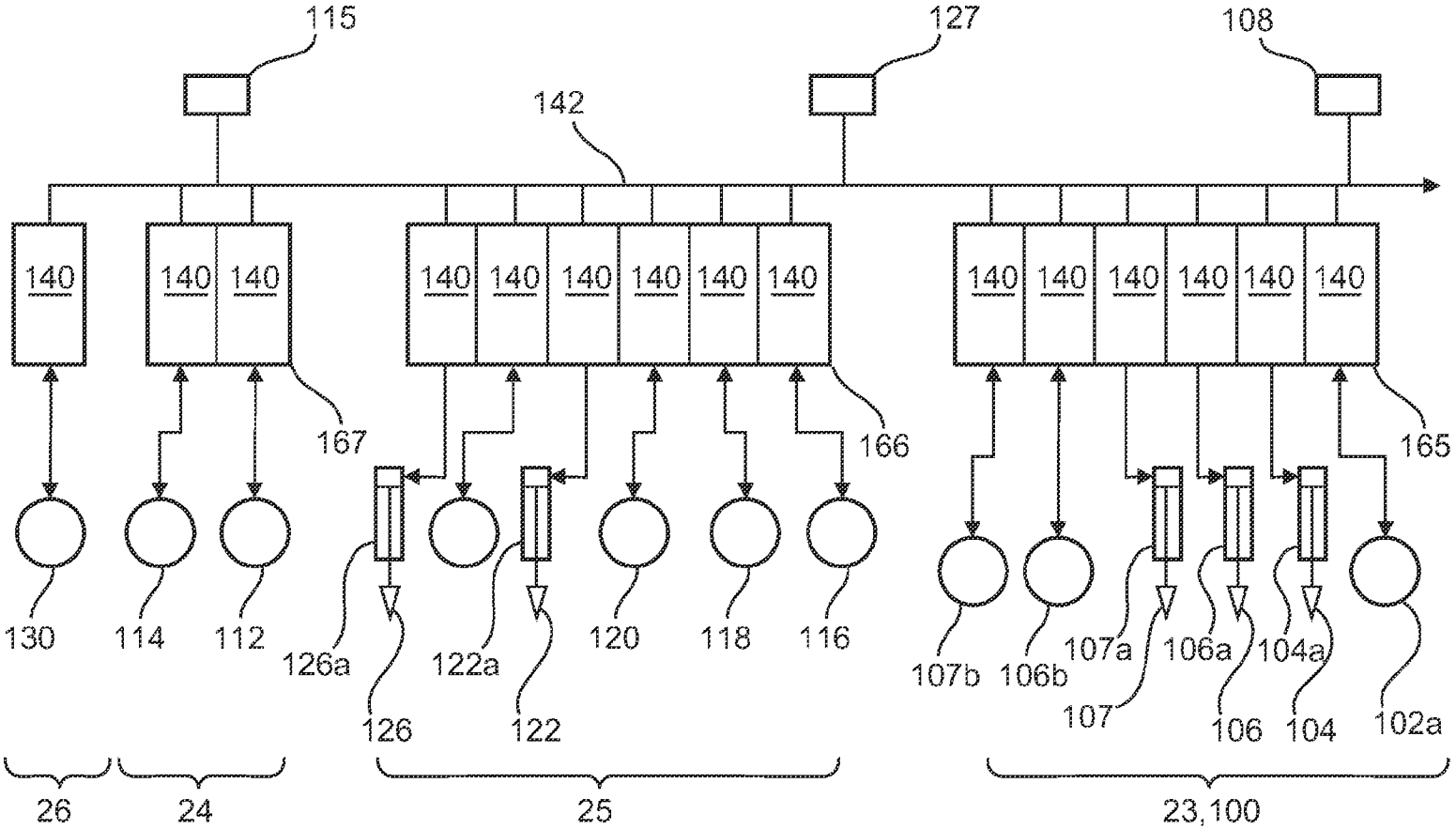
FIG. 10*b* diagrammatically in block diagram representation the second part of the drive configuration of the photo book machine.

In the exemplary embodiment shown, the three side cutting station 100 has a gripper, which is shown diagrammatically in FIG. 7 and is labeled by reference number "102." The gripper 102, for the movement of which an associated drive 102*a* is provided, which is not shown in FIG. 7 but is shown diagrammatically in FIG. 10*b*, takes over the book block 96 from the previously mentioned transfer device, not shown in FIG. 5, which connects the cooling station 92 in the second module 22 to the three-side cutting station 100 in the third module 23. The arriving book block 96 thereby with its forward edge 96*a* comes into engagement with the gripper 102. This situation is shown as Step I in FIG. 7.

The gripper 102 draws the book block 96 onto a tray-shaped base 103, which in the exemplary embodiment shown is a component of the three-side cutting station 100. The gripper 102 thereby brings the book block 96 into a defined position on the base 103, as is shown diagrammatically by Step II in FIG. 7. To this end, the forward edge 96*a* of the book block 96, which coincides with the crease edge 52*a* of the creased sheet 52 (FIG. 6) comes to rest on a defined virtual line running crosswise to the direction of movement according to arrow A, which line is not shown in the figures and is spaced apart from a virtual cutting line, not shown in the figures either, running parallel hereto with format accuracy.

As FIGS. 7 and 8 further show, the three-side cutting station 100 has a cross-cutter 104, which produces the previously mentioned virtual cutting line, extends crosswise to the transport direction according to arrow A essentially over the entire width of the base 103 in the direction of the double arrow F and is supported in a vertically moveable manner, as well as two lateral blades 106, 107 spaced apart from one another, which are oriented in the transport direction according to arrow A and are likewise supported in a vertically moveable manner. Moreover, the two lateral blades 106, 107 spaced apart from one another are arranged in an adjustable manner for the purpose of format adjustment over the width of the base 103 crosswise to the transport direction according to arrow A in the direction of the double arrow F. Drives 104*a*, 106*a* and 107*a*, not shown in FIG. 7 but shown diagrammatically in FIG. 10*b*, ensure that the blades 104, 106, 107 can be brought from an upper rest position into a lower operating position, wherein the blades 104, 106, 107 are arranged to be moveable obliquely downwards for an efficient cut. Furthermore, for the transverse adjustments of the two lateral blades 106, 107 spaced apart from one another for the purpose of format adjustment corresponding linear drives 106*b*, 107*b* are provided, which are not shown in FIG. 7 either, but are shown diagrammatically in FIG. 10*b*.

After the book block 96 has been brought into the position 96 shown in Step II of FIG. 7, the cross-cutter 104 is lowered, in order to cut off from the book block 96 a superfluous trailing edge section lying at a distance from the crease edge 52*a* (FIG. 6), whereby the book block 96 is given a defined, uniform and clean edge 96*b*, as can be seen in the representation of the subsequent Step III in FIG. 7. The book block 96 is thus brought into the desired format length.

After the separation of the trailing edge section by the cross cutter 104, the book block 96 is moved in the three-side cutting station 100 by the gripper 102 a little further in the transport direction according to arrow A and thereby into the operating range of the two lateral blades 106, 107, as is shown by Step III in FIG. 7. After the two lateral blades 106, 107 have been adjusted to the desired format width, they are lowered and the superfluous side edge sections are thereby cut off the book block 96 to form defined, uniform and clean side edges. The previously described operations are monitored by a sensor device 108, which is not shown in FIG. 7, but is shown diagrammatically in FIG. 10*b*, the output signals of which are used to control or regulate the three-side cutting station 100.

The book block 96 now cut to the desired format is shown in Step IV of FIG. 7. Accordingly, the forward edge 96*a* of the book block 96 remains unprocessed, since it forms the defined zero edge, as it were and coincides with the crease edge 52*a* of the creased sheets 52 (FIG. 6), while to obtain the desired format the three other edges are cut by the blades 104, 106 and 107 in the three-side cutting station 100 accordingly.

The book block 96 now cut to the desired format is subsequently transferred into the fifth module 25, in which it is joined to a book cover supplied in the meantime in the fourth module 24. The "pairing" of book block and associated book cover then forms the completed photo book 14 (FIG. 1) and is released from the photo book machine 2 via the sixth module 26.

For the feeding and alignment of a book cover, which belongs to, that is, is assigned to the book block released from the third module 23, and has been produced essentially simultaneously with the production of the book block, in the fourth module 24 embodied as a book cover supply station, in particular a linear drive 112 and a lift drive 114 as well as a sensor device 115 in particular for detecting a job code located on the book cover as well as optionally further also for detecting the position and alignment of the book cover are provided, as is indicated diagrammatically in FIG. 10*b*.

Figure 8A:
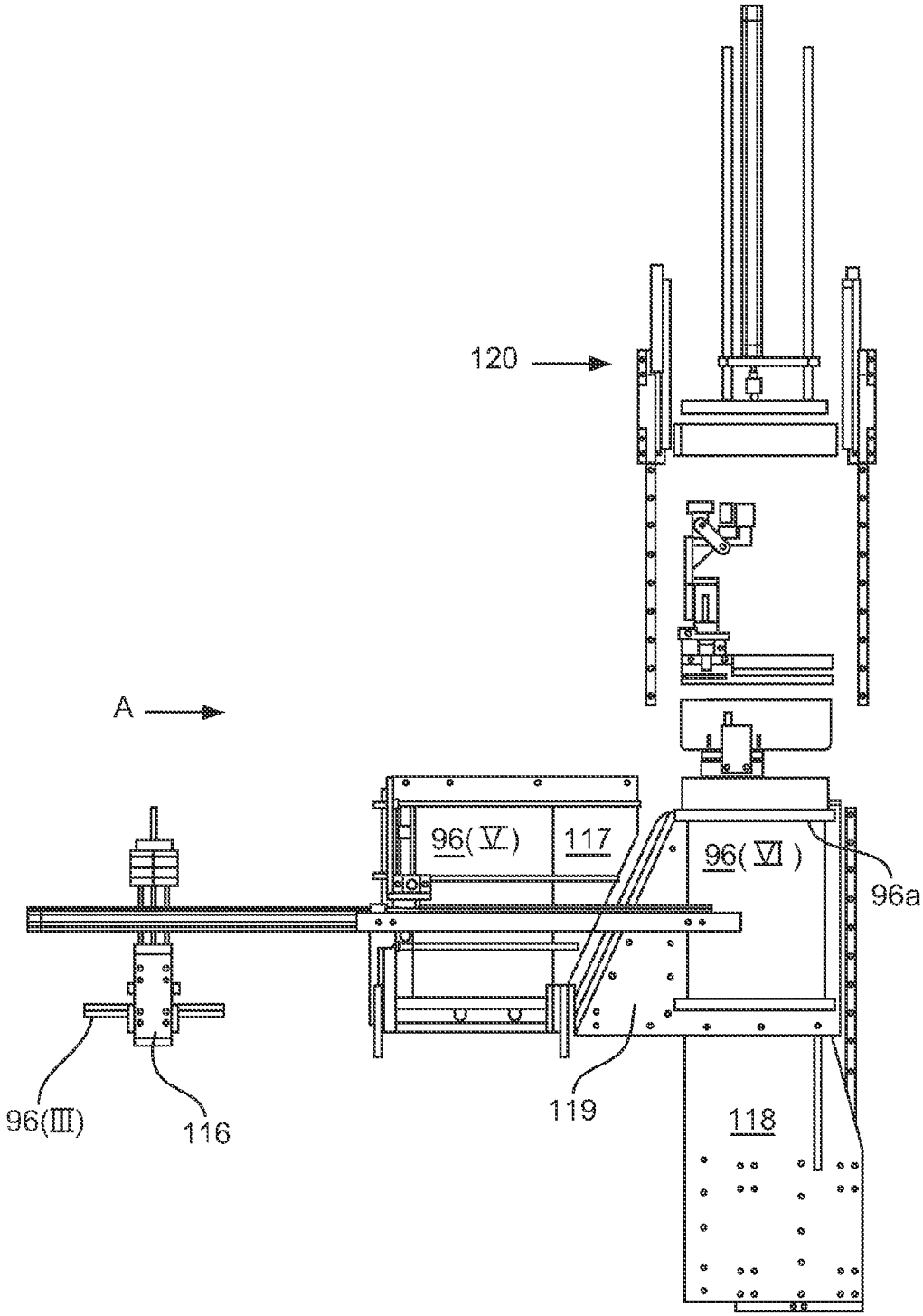
FIG. 8*a* diagrammatically in side view a joining station contained in the fifth module of the photo book machine according to a preferred embodiment of the invention.
Figure 8B:
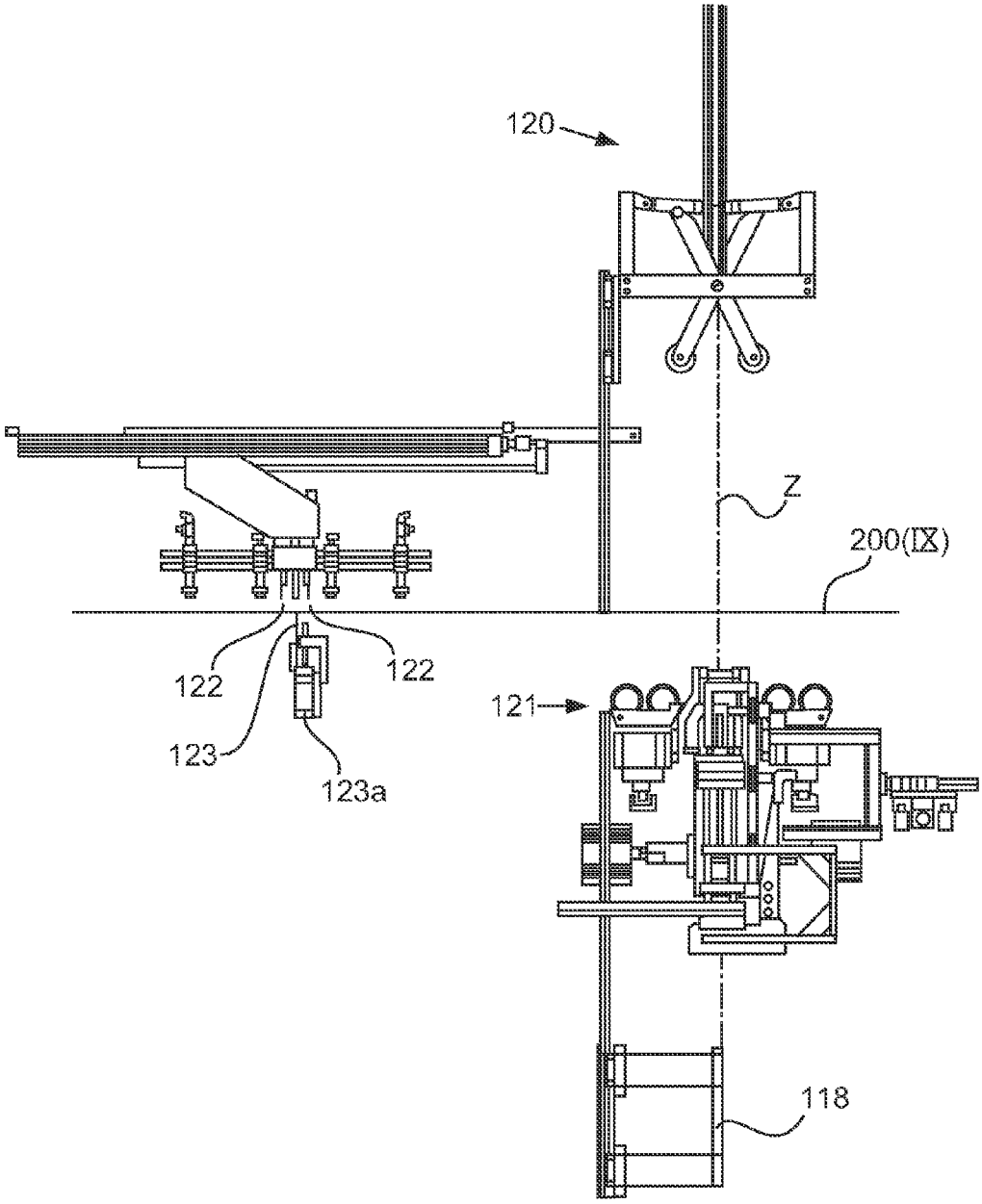
FIG. 8*b* diagrammatically the joining station from FIG. 8*a* in a side view rotated by 90° compared to FIG. 8*a;*
Figure 9:
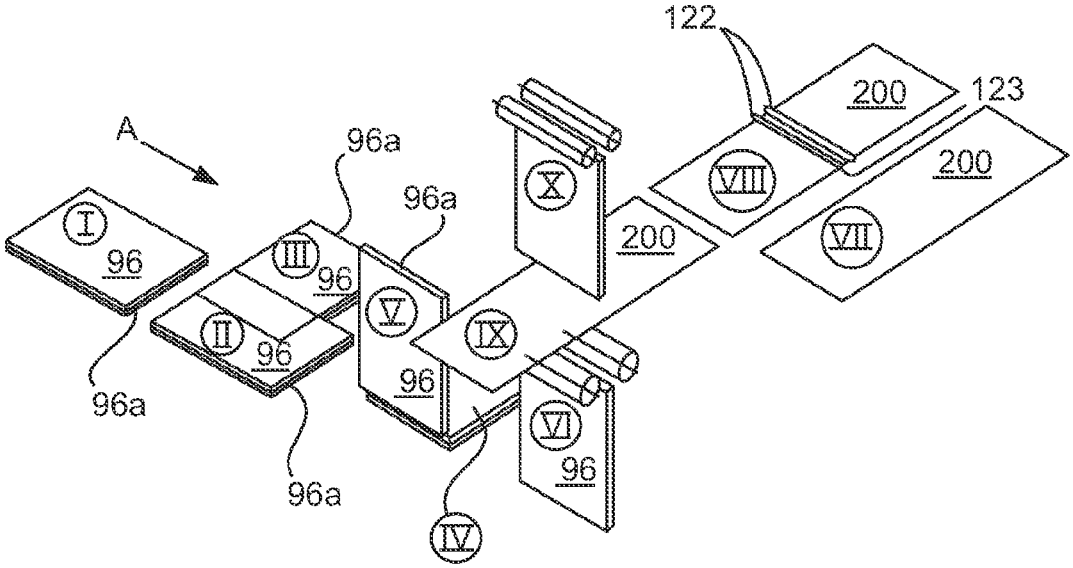
FIG. 9 diagrammatically the operating sequence in the joining station according to FIGS. 8*a* and 8*b* by means of simultaneous representation of individual operating steps in perspective view.

The structure of the device for joining book block and book cover, with an explanation at the same time of the operating sequence, as is shown diagrammatically in FIG. 9, is described below based on FIGS. 8*a* and 8*b*. In the representation of the figures, the paper travel direction or conveyor direction or transport direction and the process direction run from left to right, which is indicated by the arrow A.

As is shown in particular by FIGS. 8*a* and 9, the book blocks 96 are fed in a horizontal alignment, thus in a horizontal conveyor plane to us. Firstly the book block 96 thereby moves with its spine 96*a* in front, which is formed by the crease lines lying one above the other of the individual layers. This transport condition can be seen in FIG. 9 based on the positions I and II. The transport is carried out by conveyor means, not shown, which can have, for example, an endless circulating conveyor belt. The book block 96 is transferred to a pivot/rotation unit 116, which is shown diagrammatically in FIG. 9*a*. The pivot/rotation unit 116 grasps the book block 96 in its position II and rotates it by 90° so that it is brought with its spine 96*a* to bear against a bearing edge 6, as can be seen based on the position III shown in FIG. 9. Due to the bearing against the bearing edge, the book block 96 with its spine 96*a* is aligned with respect to a so-called machine zero edge, which is formed by the bearing edge in the exemplary embodiment shown; in this manner it is possible that book blocks with different formats can always be positioned at the same machine zero edge.

The book block 96 is displaced along the bearing edge with its spine 96*a* bearing there in the transport direction according to arrow A into the position IV shown in FIG. 9. This can be carried out, for example, with the aid of the pivot/rotation device 116, if this is supported in a correspondingly displaceable manner.

With the movement into the position IV according to FIG. 9, the book block 96 is conveyed onto a mounting table, which at this time is in a horizontal position and subsequently is tilted up by 90° into a vertical alignment. In FIG. 8*a* this mounting table is shown in its already tilted up upright position and provided with reference number "117." As FIG. 8*a* further shows, the mounting table 117 is provided with two lateral strips that extend in the transport direction according to arrow A and are spaced apart from one another. These two lateral strips serve as stops on the side edges of a book block 96 removed from the mounting table 117, in order to fix the book block 96 crosswise to the transport direction according to arrow A. With respect to different widths of the book blocks 96 with different formats, the (lower, according to FIG. 8*a*) lateral strip is arranged in a displaceable manner along the surface of the mounting table 117 crosswise to the transport direction according to arrow A.

In the exemplary embodiment shown the (upper, according to FIG. 8*a*) lateral strip is attached to the mounting table in a stationary manner and is thereby arranged and aligned such that it is aligned with the previously mentioned bearing edge or forms a section of the bearing edge when the mounting table 117 is in its horizontal position in which the book block 96 is received on the mounting table 117 into the position IV according to FIG. 9. By tilting up the mounting table into the upright position shown in FIG. 8*a*, the book block 96 located on the mounting table 117 is likewise brought into a vertically upright position, which is labeled by "V" in FIG. 9. So that the book block 96 remains fixed to the mounting table even during the pivoting movement and in the upright position of the mounting table 117, the mounting table 117 is furthermore provided with locking means or engagement means (for example, in the form of clamps), not shown in the figures, for the detachable fixing of the book block 96 on the surface of the mounting table 117.

In the exemplary embodiment shown, the mounting table 117 is not only pivotable in the manner previously described, but also supported in a linear moveable manner in the transport direction according to arrow A, so that it can be displaced in the direction of a knife case 119. This pivot movement and this linear movement are generated by a drive, not shown in the figures. In FIG. 8*a* the mounting table 117 is shown in a position directly adjacent to the knife case 119. The knife case 119 is a narrow case, which is arranged in an upright or vertical manner and extends parallel to that virtual plane that is spanned by the mounting table 117 in the upright position thereof according to FIG. 8*a*. The knife case 119 is composed essentially of two plates, the small distance from one another of which is essentially measured such that they can accommodate a knife 118 between them. The knife 118 is arranged in the same vertical virtual plane as the knife case 119 and supported in a moveable manner in the vertical direction along a rail system. The lifting and lowering of the knife 118 along the rail system is carried out by a drive, not shown in the figures either. The knife 118 is shown in its lower position in FIG. 8*a*. So that the knife 118 can run through the knife case 119 during its upward and downward movement, the lower edge 12*a* thereof and the upper edge thereof are open and form a correspondingly slot-shaped opening.

Fingers, not shown in the figures, push the book block 96 from its position V on the mounting table 117 on the knife case 119 into a position VI. A comparison of the positions V and VI in FIG. 9 shows that they lie in the same virtual plane, in which the book block 96 is pushed accordingly in the transport direction according to arrow A onto the knife case 119. The edge of the knife case 119 pointing towards the mounting table 117 thereby grasps into the book block 96 between two book pages into the center thereof, so that the book block comes to rest in the position V with its one half on the one side and with its other half on the other side of the knife case 119. In order during this pushing-on movement to avoid damage to the free edges of the book pages by the side edge of the knife case 119 pointing towards the mounting table 117, in the exemplary embodiment shown according to FIG. 8*a*, this side edge of the knife case is embodied tilted with respect to the vertical in order thus to guarantee a gradual and gentle engagement of the knife case 119 with its side edge into the book block 96. In order furthermore to avoid marks and other damage on the inner pages of the book block, in particular in the region of the spine, during the pushing-on movement, the book block 96 is supported not only by the (lower in the upright position according to FIG. 8*a*) lateral strip arranged on the mounting table 117, but also by a strip-shaped support, which is arranged on the knife case 119, as further shown by FIG. 8*a*. The support is supported in an adjustable manner in the vertical direction and is adjusted at a height at which it is aligned with the (lower, in the upright position of the mounting table 117 according to FIG. 8*a*) lateral strip of the mounting table 117. The arrangement of the stationary lateral strip 8*a* on the mounting table 117 and the adjustable lateral strip 8*b* on the mounting table 117 and the likewise adjustable support 17 on the knife case 119 is determined such that the book block 96 with its spine 96*a* is pushed at a certain vertical distance from the upper edge 12*b* of the knife case 119 onto the knife case 119 in order to prevent the upper edge 12*b* of the knife case 119 from also causing marks or other damage inside the book block 96. Like the lateral strip on the mounting table 117, with a format change in the same manner the support is also adjusted vertically on the knife case 119 at right angles to the transport direction according to arrow A. Preferably, a strip-shaped support is provided on each of the two outsides of the knife case 119, wherein both supports are synchronously adjustable in the vertical direction and thereby always lie at the same vertical height.

Furthermore, the arrangement and alignment of the mounting table 8 in its upright position according to FIG. 8*a* must be determined with respect to the knife case 119 such that the knife case 119 engages with its lateral edge centrally in the book block 96 when the latter is pushed from the position V into the position VI onto the knife case 119. So that book blocks or books with different thicknesses can be processed, the mounting table 117 is furthermore supported such that in its upright position according to FIG. 8*a*, it is also adjustable crosswise to the transport direction according to arrow A. In this manner the last degree of freedom, namely the variance of the thickness of the book block 96 can be eliminated, since the mounting table 117 due to the mentioned crosswise adjustment in its upright position according to FIG. 8*a* carries out a type of averaging, based on the thickness of the book block 96.

After the arrangement of the book block 96 in its position VI on the knife case 119, the knife 14 leaves its lower position shown in FIG. 8*a*, moves upwards through the knife case 119 and grasps with its upper edge (not shown in the figures) emerging on the upper edge 12*b* of the knife case 119 into the inside of the spine 96*a* inside the book block 96 in order to carry the book block 96 along accordingly with continued upward movement and thus to lift it in the vertical direction from the knife case 119.

As FIGS. 8*a* and 8*b* further show, a feeding station 18 is located above the knife case 119, the purpose of which is to align and feed a book cover for joining with the book block 96 accordingly. Book covers of this type are shown in particular in FIG. 9 and labeled by reference number "200." The delivery of the book covers 200, which takes place essentially at the same time as the delivery of the book blocks 96, takes place from the side in the exemplary embodiment shown, as positions VII and VIII show, in which in FIGS. 4*a* and 4*c* respectively one book cover 200 is shown. During the delivery and in the positions VII and VIII as well as IX shown in FIG. 9, the book covers 200, which are preferably composed of cardboard or at least a thicker paper layer, take on a form spread out flat.

After transfer from the delivery position VII into position VIII by a conveyor device, not shown, the book cover 200 is aligned centered with respect to two groove strips 122 spaced apart and parallel to one another, which subsequently pressed into the surface of the book cover 200 in order to form two grooves spaced apart from one another accordingly and running centrally crosswise to the longitudinal extension of the book cover 200. The groove strips 122 are moved and driven by corresponding handling devices, not shown. As FIGS. 8*b* and 9 further indicate, a counter strip 123 is provided below that plane in which the book cover 200 is in its positions VIII and IX and thus below the book cover 200, while the groove strips 122 are arranged above this plane and thus above the book cover 200. The counter strip 123 extends parallel to the groove strips 122 and lies in the center between them. The counter strip 123 is raised and lowered by a lift drive 23*a* and serves on the one hand as a type of abutment with respect to the upper groove strips 122 and on the other hand for embossing a groove, not shown in the drawings, on the inside of the book cover 200 in the center. With the aid of the groove strips 122, the grooves can be embossed for the first time into the book cover 200 in its position VIII according to FIG. 9, or, if in a previous operating step corresponding grooves have already been made in the book cover 200, these grooves are emphasized more markedly. The embodiment or emphasizing of the grooves in the book cover 200 is a preparatory measure before the joining of the book block 96 and the assigned book cover 200. The grooves 20*a* serve in particular to form a hinge in the manner of a film hinge in the book cover 200, in order on the one hand to facilitate a targeted, positionally accurate turning of the book cover 200 while it is being joined to the book block 96 and on the other hand to facilitate the opening and closing of the completed book.

As shown in particular by FIGS. 8*a* and 8*b*, a gluing station 121 is arranged directly above the knife case 119. If now the knife 14 emerges during its upward movement out of the upper edge of the knife case 119, the book block 96, up to that point still bearing in position VI against the knife case 119, is carried along by the knife 118 and lifted accordingly. During this lifting movement, the book block 96 first passes through the gluing station 121 and is glued over the entire surface on its two outsides. The vertical path or the vertical plane along which the knife 118 moves and carries along the book block 96 in the upward direction accordingly, is indicated in FIG. 2 by a dot-dashed line labeled by reference character "Z." In the exemplary embodiment shown, the gluing station 121 has two arrangements provided on both sides of the conveyor plane or of the conveyor path Z composed of a glue application roller, a further distribution roller in contact therewith and a trough containing glue and accommodating the two rollers. Both of these arrangements or at least the glue application rollers can be brought between an operating position, in which they can be brought for a gluing operation into contacting bearing against an outside of a book block 96 running upwards through the gluing station 121, and a rest position, in which the two glue application rollers lie at a greater distance from one another than in the operating position, so that there is no glue application on a book block running through the gluing station 121, in particular in the downward direction.

As can be seen in particular in FIGS. 8*a* and 8*b*, above the gluing station 121 a so-called pressing-on station 28 is located, in which after leaving the gluing station 121 the book block 96 is moved during its continued upward movement along the vertical conveyor plane or the vertical conveyor path Z. During this continued upward or lift movement, the book block comes to bear with its forward spine 96*a* against the underside of a center strip-shaped section 20*b* forming the later book spine of that book cover 200 which is in particular in the position IX shown in FIG. 9 and thus lies spread out flat in horizontal alignment and centered above the gluing station 121 with respect to the vertical conveyor path or the vertical conveyor plane Z. While the book block 96 continues its upward movement, it carries along the strip-shaped center section of the book cover 200, while engagement means, not shown, in the joining station 28 ensure that with the continued upward movement of the book block 20 the two halves of the book cover 200, located in the position IX up to this point, are placed against the outsides of the book block 96. The upward movement is continued in the joining station until an upper position is reached, which is shown as position X in FIG. 9. The feeding station furthermore has two press-on rollers spaced apart from one another. Furthermore, a so-called spine strip is provided, which is aligned horizontally and is located at the lower end of a guide device. With the aid of the guide device, the spine strip can be moved between the two press-on rollers in the vertical direction.

In FIGS. 8*a*, 8*b* and 9 the press-on rollers are shown in their upper position. For a better adhesion of the two halves of the book cover 200 with the glued outsides of the book block 96, the press-on rollers 30 are brought to bear against the outsides of the two folded up halves of the book cover 200. To this end, the two press-on rollers surround from above the book block 96 located in its upper position X according to FIG. 9 and provided with the book cover 200, which book block together with the book cover 200 as it were forms the "book" pair. During the subsequent vertical downward movement, the two press-on rollers roll along the outside of the book and apply pressure at the same time on the halves of the book cover 200 in order to cause an effective, bubble-free, high-quality adhesion with the book block 96.

After the book block 96, now already provided with the book cover 200, has reached the upper position X and also the previously described pressing-on operation with the aid of the press-on rollers has ended, a reversal of direction of movement of the knife 118 takes place, which continues to carry the book block 96 or now in the upper position X the book composed of the book block 96 and the book cover 200 lying above it. The result of the reversal of direction of movement is that the knife 118 in the exemplary embodiment shown is lowered along the same vertical conveyor path or the same vertical conveyor plane Z. The book thus leaves the pressing-on station backwards, as it were, and also runs backwards through the gluing station 121. During this the press-on rollers of the pressing-on station as well as the glue application rollers of the gluing station 121 are opened, in order not to impede the downward movement and to avoid an undesirable further application of glue.

With continued lowering or downward movement, the book reaches the lower position VI and is thereby placed again on the knife case 119, now coming from above, while the knife 118 moves further into the knife case 119 until it reaches the lower position shown in FIG. 8*a*. Since in the lower position VI the book bearing on both sides of the knife case 119 now is supported again on its free edge pointing downwards by the support such that the book does not bear with its spine against the upper edge of the knife case 119, but instead is unloaded thereby and thus an engagement of the upper edge of the knife case 119 with the interior of the book is ruled out, with the removal of the book from the knife case 119 there is no danger either that marks or other damage is produced in the interior of the book.

As is further shown diagrammatically by FIG. 10*b*, the module 25 has a drive 116*a* for the pivot/rotation unit 116, in order to position the delivered book block 96 out of its horizontal alignment upright with its spine upwards. To move the knife 118, which subsequently moves into the book block, in the upward and downward direction, a corresponding drive 118*a* is provided. For the alignment of the book cover 200 the joining station 120 has a corresponding device, which is driven by a drive 120*a*. For grooving the book covers corresponding suitable strip-shaped grooving tools are provided, of which a groove strip 122 is shown in FIG. 10*b* by way of example, which is set in a corresponding linear movement by an associated lift drive 122*a*. To remove and transport away a completed book, in which the book block is provided with an associated book cover, in the joining station of the fifth module 25 a gripper conveyor, not shown, is used, the drive of which however is shown diagrammatically in FIG. 10*b* and is labeled by reference number "124." As FIG. 10*b* further shows diagrammatically, the fifth module 25 of the photo book machine 2 in the exemplary embodiment shown also has a crease press 126, which is actuated by an associated lift drive 126*a*. Finally in the fifth module 25, a sensor device 127, indicated diagrammatically in FIG. 10*b*, is provided, with which in particular the current position of the book block and the finished book is detected and monitored.

The issue of the finished photo book takes place via a delivery conveyor, not shown in the figures, provided in the sixth module 26, the associated drive of which is shown diagrammatically in FIG. 10*b* and is labeled by reference number "130."

As FIGS. 10*a* and b further show, the individual drives are respectively connected to an assigned drive control device 140. The respectively assigned drives can be separately controlled or regulated via the drive control devices 140.

The sensors or sensor devices 41, 55, 71, 81, 108, 115 and 127 as well as the individual drive control devices 140 are jointly coupled to one another via a bus system 142, to which in addition a superordinate main control device 150 is connected, which is shown in FIG. 10*a*. In turn, an operating and display unit 152, a job control device 154 and a control device 156 for further processing machines, not shown in the figures, are connected to the main control device 150, as is further indicated by FIG. 10*a*.

At least one of the sensor devices 41 and 55 are provided for detecting print marks and print job codes located (not shown in the drawings) on the sheet web 34, wherein the print marks and the print job codes contain order data that are retrieved via the bus system 142 and the main control device 150 of the superordinate order control device 154 and preferably contain an order ID, sheet dimensions and number of sheets of a book block to be produced. In the main control device 150 and/or in the job control device 154 a data comparison device is provided, which compares to one another the order ID of a predetermined book block and the order ID of the associated predetermined book cover, and if they do not agree generates a warning signal and/or activates an extraction device contained in the fifth module 25 for eliminating the book block that cannot be assigned and/or the book cover that cannot be assigned.

As FIGS. 10*a* and 10*b* further indicate, the drive control devices 140 are respectively assembled or assigned respectively for the drives 32*a*, 42*a* of the rolling and the first pair of tension rollers 42 to a station control device 160 for drawing a sheet web 34 off the sheet web roll 30 (FIG. 4) and the drive control devices 140 for the drives 48*a*, 54*a* and 59 of the second pair of tension rollers 48, the cross-cutting unit 50 and the suction belt conveyor 56 to a station control device 161 for the cross-cutting station 50 (FIG. 4) in the first module 21. The drive control devices 140 for the drives 64*a*, 66*a*, 68*a*, 70*d* and 72*d* of the third pair of tension rollers 64, the upper die 66 provided as a grooving tool, the transport roller 68, the creasing rollers 70*a* through 70*c* as well as the creasing knife 72 are assembled or assigned to a station control device 162 for the grooving and creasing station 62 (FIGS. 5, 6), the drive control device 140 for the drives 73*a*, 78*a* and 82*a* of the conveyor belt 73, the glue device 78 and the suction belt conveyor 82 to a station control device 163 for the adhesive application station 76 (FIG. 5) and the drive control devices 140 for the drives 89*a* and 98*a* of the conveyor chains 88, 98 to a common station control device 164 for the laminating and cooling stations 84, 92 in the second module 22. The drive control devices 140 for the drives 102*a*, 104*a*, 106*a*, 106*b*, 107*a*, 107*b* of the gripper conveyor 102, the cross cutter 104 as well as the lateral blades 106, 107 together with format adjustment device are assembled or assigned to a station control device for the three-side cutting station 100 (FIG. 7) in the third module 23. The drive control devices 140 for the drives 116*a*, 118*a*, 120*a*, 122*a*, 124*a* and 126*a* of the pivoting device 116, the saddle plate 118, the conveyor device 120, the grooving tool 122, the gripper conveyor 124 as well as the creasing press 128 are assembled or assigned to a station control device 166 for the fifth module 25 containing the joining station, and the drive control devices 140 for the linear drive 112 and the lift drive 114 are assembled or assigned to form a station control device 167 for the fourth module 24 containing the sheet cover feeding station.

The main control device 150, the drive control devices 140 and the station control devices 160 through 167 are embodied and adjusted for an automatic, uninterrupted format change.

The main control device 150 and/or at least one of the station control devices 160 through 167 contain at least three shift registers, not shown in the figures, to track the uncreased and creased sheets 42, the book block 96 and the book cover as well as the completed book. One of the shift registers thereby contains the order data for the book blocks and another shift register contains the order IDs for the book covers. The shift registers for tracking the uncreased sheets 52, the creased sheets 52 and/or the book blocks 96 on the one hand and the shift register for tracking the book covers on the other hand are synchronized such that in the joining station of the fifth module 25, the book block and the book cover are positioned essentially simultaneously, preferably in the same shift register cycle, with the alignment of the book cover above and essentially centrally to the book block with the aid of the station control device 166.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A machine for producing books, comprising:

a sheet web dispensing station for dispensing a sheet web moved in its longitudinal direction, printed and/or coated and/or phototechnically processed on one side and provided with print marks and/or print job codes, the sheet web dispensing station comprising:

at least one supplier for supplying the sheet web, a downstream sheet web storage device, and a first conveyor device for drawing the sheet web off the at least one supplier of the sheet web and for conveying the sheet web into the sheet web storage device, a cross-cutting station downstream of the sheet web dispensing station, the cross-cutting station comprising a sensor device for detecting print marks and/or print job codes located on the sheet web and for emitting an output signal representing the result of the detection, a downstream cross-cutting unit, which is structured and arranged to cut the sheet web into discrete sheets lying one behind the other in the direction of movement, a second conveyor device, which is structured and arranged to convey the sheet web out of the sheet web dispensing station depending on the output signal of the sensor device intermittently and with format accuracy and/or with register accuracy to the cross-cutting unit, and a third conveyor device downstream of the cross-cutting unit, which is structured and arranged to convey the discrete sheets away, while achieving a predetermined distance from one another, a grooving and creasing station downstream of the cross-cutting station for centrally grooving and creasing the sheets crosswise to their direction of movement, a laminating station for the flat connection of several consecutive creased sheets to one another, the laminating station comprising:

an adhesive application device for the application of adhesive essentially over the entire surface of the top of the creased sheets, a stacker that is structured and arranged to stack several sheets one on top of the other to form a book block, and a pressing device for applying pressure in an essentially flat manner to the respectively uppermost creased sheet, a three-side cutting station comprising:

a fourth conveyor device, which is structured and arranged to convey the book block from the laminating station into the three-side cutting station depending on a selected format, such that the front edge of the book block lying opposite the book spine comes to rest on a defined cutting line running essentially crosswise to the direction of movement of the book blocks, a cross-cutter arranged along the cutting line, and two lateral blades, which are spaced apart from one another essentially crosswise to the direction of movement of the book blocks and arranged in a crosswise adjustable manner for the purpose of format adjustment, a book cover supply station for supplying and feeding a respectively predetermined individual book cover for the respective book block, the book cover supply station comprising:

a cover supplier for supplying the book covers, a fifth conveyor device for removing a book cover from the cover supplier, and a grooving device for grooving the book cover to produce a strip-shaped center section forming the spine of the book, which is bordered by two grooves and divides the book cover into two halves, a joining station downstream of the three-side cutting station for joining a book block and an assigned book cover, the joining station comprising a sixth conveyor device for bringing the book block into a joining position, an adhesive application device, which is structured and arranged to apply adhesive in an essentially flat manner on the two outsides of the book block, while the sixth conveyor device moves the book block through the adhesive application device, a seventh conveyor device for bringing the individual book cover into the joining position, a book cover feeding device for placing the two halves of the book cover onto the outsides, provided with adhesive, of the book block for completing the book, and a removal device for removing the completed book, and a dispensing station for dispensing the completed books.

2. The machine according to claim 1, in which the supplier for supplying the sheet web in the sheet dispensing station comprises a winding mandrel for receiving a sheet web roll.

3. The machine according to claim 1, in which the sheet web dispensing station comprises a device for untwisting the sheet web.

4. The machine according to claim 1, in which the sheet web dispensing station comprises a tension device for producing a predetermined web tension in the sheet web.

5. The machine according to claim 1, in which the first conveyor device and/or the second conveyor device comprises a pair of tension rollers.

6. The machine according to claim 1, in which the cross-cutting unit in the cross-cutting station comprises:

a rotatably supported blade carrier, on which a helical blade is arranged, and a counter blade arranged in a stationary manner.

7. The machine according to claim 1, in which the third conveyor device comprises a suction belt conveyor.

8. The machine according to claim 1, in which the grooving and creasing station comprises a grooving tool and a ninth conveyor device for conveying the sheets to the grooving tool.

9. The machine according to claim 8, in which the ninth conveyor device comprises a pair of tension rollers.

10. The machine according to claim 1, in which the grooving and creasing station comprises at least two creasing rollers supported in a rotatable manner.

11. The machine according to claim 10, further comprising a creasing knife, wherein the at least two creasing rollers, are in active engagement with the creasing knife.

12. The machine according to claim 1, in which the grooving and creasing station comprises an extraction device for eliminating a faulty sheet.

13. The machine according to claim 1, in which the adhesive application device in the laminating station comprises an adjustable adhesive application nozzle device.

14. The machine according to claim 13, in which the adhesive application nozzle device comprises a wide slot nozzle.

15. The machine according to claim 1, in which the pressure device in the laminating station comprises at least one press-on roller supported in a moveable manner.

16. The machine according to claim 1, in which the laminating station comprises a cooling device for cooling the adhesive connections in the book block.

17. The machine according to claim 1, in which the fourth conveyor device in the three-side cutting station comprises a gripper conveyor structured and arranged to grip a section of the book block.

18. The machine according to claim 17, wherein the gripper conveyor is structured and arranged to grip a section adjacent to the front edge of the book block.

19. The machine according to claim 1, in which the cross cutter and/or at least one of the two lateral blades is structured and arranged to be moveable obliquely downwards.

20. The machine according to claim 1, in which the cover supplier for supplying the book covers in the book cover supply station comprises a stack magazine.

21. The machine according to claim 1, in which the fifth conveyor device in the book cover supply station comprises a suction gripper.

22. The machine according to claim 1, in which the grooving device in the book cover supply station comprises at least one groove knife arranged in a moveable manner and at least one counter strip arranged in a stationary manner.

23. The machine according to claim 22, wherein the at least one groove knife is arranged in a vertically moveable manner.

24. The machine according to claim 1, in which the sixth conveyor device in the joining station comprises an upright saddle plate moveable from a lower position into an upper position, which is embodied to engage in the book block approximately centrally so that the book block can be placed with its spine on an upper edge of the saddle plate.

25. The machine according to claim 24, in which the sixth conveyor device comprises a rotation and/or pivoting device for placing the book block in an upright position with the spine pointing upwards.

26. The machine according to claim 1, in which the seventh conveyor device is structured and arranged in the joining station to align the book block in the spread out form essentially flat at an angle preferably essentially crosswise, to the conveyor direction of the sixth conveyor device.

27. The machine according to claim 1, in which the book cover feeding station comprises two moveably supported press-on rollers, which receive between them the book block provided with the book cover.

28. The machine according to claim 1, in which the eighth conveyor device in the joining station comprises a gripper conveyor.

29. The machine according to claim 1, in which the joining station comprises a crease pressing device.

30. The machine according to claim 29, in which the eighth conveyor device is structured and arranged to transport the completed book to the crease pressing device.

31. The machine according to claim 1, in which the book cover supply station comprises an extracting device for eliminating a faulty book cover and/or the joining station comprises an extracting device for eliminating a faulty book block.

32. The machine according to claim 31, further comprising a sensor device for detecting an order ID on the book cover, wherein the sensor device is coupled to the main control device and/or at least one of the station control devices and comprises a data comparison device, which is configured to compare the order ID of a predetermined book block and the order ID of the associated predetermined book cover to one another, and if they do not agree, to generate a warning signal and/or to activate the extraction device for eliminating the book block that cannot be assigned and/or the book cover that cannot be assigned.

33. The machine according to claim 1, in which at least the sheet web dispensing station, the cross-cutting station, the grooving and creasing station, the laminating station, the three-side cutting station and the joining station jointly form an arrangement lying essentially in a row next to one another, wherein the arrangement has a front accessible to operators and a back.

34. The machine according to claim 1, in which a reference line is formed for the defined guidance and alignment of the sheet web, the sheets, the book blocks and the completed books, wherein a first section of the reference line runs from the sheet web dispensing station, through through the cross-cutting station and the grooving and creasing station, to the laminating station, and defines a lateral reference line for a longitudinal side of the sheet web and the sheets, and a subsequent second section of the reference line runs from the laminating station, through the three-side cutting station, to the joining station, and defines a reference line for the center line of the book blocks and the completed books.

35. The machine according to claim 34, wherein at least the sheet web dispensing station, the cross-cutting station, the grooving and creasing station, the laminating station, the three-side cutting station and the joining station jointly form an arrangement lying essentially in a row next to one another, wherein the arrangement has a front accessible to operators and a back, and in which the first section of the reference line runs adjacent to the back.

36. The machine according to claim 1, further comprising a main control device and a plurality of station control devices coupled to the main control device, which are assigned to at least some of the stations, wherein the conveyor devices have respectively at least one drive that can be controlled and/or regulated separately, and respectively at least one path measurement device operating in a rotational or linear manner, wherein at least one of the stations has respectively a format adjustment device for adjusting different formats, and wherein the main control device and/or the station control devices are structured and arranged and adjusted for an automatic uninterrupted format change.

37. The machine according to claim 36, in which the sensor device for detecting print marks and/or print job codes on the sheet web is coupled to the main control device and/or at least one of the station control devices, and the machine further comprises a superordinate order control device coupled with the main control device and/or at least one of the station control devices, wherein the print marks and/or print job codes have order data retrievable via the main control device and/or at least one station control device by the superordinate order control device.

38. The machine according to claim 37 in which the main control device and/or at least one station control device has at least three shift registers for tracking the uncreased and creased sheets, the book block and the book cover as well as the completed book, wherein the shift registers for tracking the uncreased sheets, the creased sheets and/or the book block on the one hand and the shift registers for tracking the book cover on the other hand are synchronized such that the book block with the aid of the sixth conveyor device and the book cover with the aid of the seventh conveyor device can be positioned essentially at the same time, with the alignment of the book cover above and essentially centrally to the book block by the station control device assigned thereto.

39. The machine according to claim 38, wherein the order data contains an order ID, sheet dimensions and number of sheets of a book block to be produced, and wherein one of the shift registers contains the order data for the book blocks and another shift register contains the order IDs for the book covers.

40. The machine according to claim 38, wherein the book block with the aid of the sixth conveyor device and the book cover with the aid of the seventh conveyor device can be positioned in the same shift register cycle.

41. The machine according to claim 37, wherein the order data contains an order ID, sheet dimensions and number of sheets of a book block to be produced.

42. The machine according to claim 36, wherein the plurality of station control devices are coupled to the main control device via a bus system.

43. The machine according to claim 36, wherein the plurality of station control devices are assigned to at least one of the sheet web dispensing station, the cross-cutting station, the grooving and creasing station, the laminating station, the book cover supply station, and the joining station.

44. The machine according to claim 36, wherein the different formats include sheet formats and book block formats, as well as book formats.

45. The machine according to claim 1, wherein the books are photo books and/or illustrated books.

46. The machine according to claim 1, wherein the dispensing station dispenses the completed books to a downstream packing machine.

* * * * *

UNITED STATES PATENT AND TRADEMARK OFFICE

CERTIFICATE OF CORRECTION

PATENT NO. : 8,870,174 B2
APPLICATION NO. : 13/440177
DATED : October 28, 2014
INVENTOR(S) : M. Mueller It is certified that error appears in the above-identified patent and that said Letters Patent is hereby corrected as shown below:

In The Claims

Column 22, line 17 (claim 1, line 72) please change “comprising” to -- comprising: --.
Column 24, line 18 (claim 34, line 6) please change “through through the” to -- through the --.

Signed and Sealed this
Fourth Day of August, 2015

Michelle K. Lee

Michelle K. Lee
*Director of the United States Patent and Trademark Office*